United States Patent [19]

Gagnon

[11] 4,264,783

[45] Apr. 28, 1981

[54] DIGITAL SPEECH SYNTHESIZER HAVING AN ANALOG DELAY LINE VOCAL TRACT

[75] Inventor: Richard T. Gagnon, Rochester, Mich.

[73] Assignee: Federal Screw Works, Detroit, Mich.

[21] Appl. No.: 952,792

[22] Filed: Oct. 19, 1978

[51] Int. Cl.[3] ..... G10L 1/00

[52] U.S. Cl. ..... 179/1 SD

[58] Field of Search ..... 179/1 SA, 1 SD, 1 SE, 179/1 SC; 333/217; 330/107, 109; 364/724, 825

[56] References Cited

U.S. PATENT DOCUMENTS

| | | | |
|---|---|---|---|
| 3,588,353 | 6/1971 | Martin | 179/1 SM |
| 3,701,059 | 10/1972 | Nyswander | 330/107 |
| 3,750,037 | 7/1973 | Schmidt | 333/217 |
| 4,130,730 | 12/1978 | Ostrowski | 179/1 SM |

OTHER PUBLICATIONS

P. Leiberman, "Speech Physiology and Acoustic Phonetics", MacMillan, 1977, p. 108, (FIG. 6-22).

J. L. Flanagan, "Speech Analysis and Synthesis", Springer-Verlag, 1972, pp. 77, 78.

*Primary Examiner*—Charles E. Atkinson
*Assistant Examiner*—E. S. Kemeny
*Attorney, Agent, or Firm*—Harness, Dickey & Pierce

[57] ABSTRACT

A phoneme based speed synthesizer that utilizes an analog delay line (ADL) vocal tract which simulates the variations in the acoustical characteristics of the human vocal tract which occur as a result of changes in the cross-sectional area of the human vocal tract at different points along its length. The ADL vocal tract comprises a plurality of T-sections having a resistor as the series component and a frequency dependent negative resistance (FDNR) as the shunt component. Both the series and shunt components are readily tunable via electric control signals, although in the preferred embodiment only the series resistive elements are tuned. Except for the vocal excitation source, the ADL vocal tract is driven entirely by digital circuitry, including novel digital transition circuitry for producing gradual variations in the values of the control signals as they change from phoneme to phoneme.

44 Claims, 10 Drawing Figures

To Delay Board
Master Timing Pulse
Phoneme Timer Enable
Rom Data Strobe (To Fig. 6)
Write Pulse (To Fig. 5)
Speech Rate Input (16)
Rom Data Strobe
TR Timing
Frame Sync.
CLK
Frame Pulse
CLK

DIGITAL SPEECH SYNTHESIZER HAVING AN ANALOG DELAY LINE VOCAL TRACT

BACKGROUND AND SUMMARY OF THE INVENTION

The present invention relates to speech synthesizers and in particular to an improved phoneme based speech synthesizer that is capable of producing high quality speech and yet is inexpensive to manufacture and requires a low data bit rate.

Since human speech is an analog process, it is not surprising that most speech synthesizers heretofore developed have been analog synthesizers. While successful high quality analog synthesizers have been designed, it has generally been recognized that a digital system capable of producing comparable speech quality would be preferred because of the reliability, size and cost advantages associated with digital circuitry. Towards this end, a voice compression technique called linear predictive coding (LPC) has been recently developed which utilizes a digital filter to model the human vocal tract. While this approach to speech synthesis appears to have promise, LPC systems are typically quite complex and require relatively high input data rates to produce quality speech. Consequently, the above noted advantages of such a digital synthesizer are compromised.

The present speech synthesizer utilizes a novel highly simplified analog vocal tract which requires only four control parameters to produce high quality speech, and drives the vocal tract with a completely digital control system. The result is a speech synthesizer that is highly simplified, exceptionally cost effective, and yet is capable of producing a level of speech quality that duplicates or exceeds the most sophisticated designs presently available. Moreover, since the present speech synthesizer is a phoneme based synthesizer, the input data rate required to drive the system is very low.

The vocal tract used in the present system comprises an analog delay line (ADL) which accurately simulates the characteristics of the human vocal tract. Unlike conventional speech synthesizers which employ vocal tracts comprising a plurality of cascaded or parallel connected resonant filters, the present ADL vocal tract comprises a single interactive bilateral filter network.

In general, the design of the ADL vocal tract is based upon the electronic model of the human vocal tract which simulates the effects of changing vocal tract geometry. It has long been known that the acoustical characteristics of the human vocal tract are varied by changes in the cross-sectional area of the vocal tract at different points along its length. In this respect, the human vocal tract exhibits the acoustical characteristics of an acoustic tube whose cross-sectional dimensions are small relative to the wavelengths of the frequencies generated. An acoustical system of this type can be represented electrically by a plurality of T-sections whose series element is an inductance and whose shunt element is a capacitance. Each stage thus represents a given length of the acoustic system as determined by the number of stages utilized. Accordingly, it will be appreciated that the effective cross-sectional area of each section can be electrically adjusted by varying the impedance of the components.

However, while the merits of the theoretical electrical model have been recognized, practical implementation of the model has proved to present significant design problems. Specifically, attempts at designing an electrically controllable inductive/capacitive network have resulted in systems of extreme complexity. Moreover, due to the inherent imperfections associated with the many circuit approximations required, much of the desired characteristics of the theoretical electrical model are lost. Consequently, the quality of the speech produced thereby is compromised. Thus, despite its initial promise a practical ADL vocal tract has yet to be produced.

The speech synthesizer of the present invention provides a novel approach to the implementation of an ADL vocal tract. Specifically, rather than attempting to provide directly eletrically variable inductances and capacitances, the present invention utilizes time domain equivalents of these components. Specifically, in the domain, inductances and capacitances are 180° out of phase. Therefore, if the time domain reference is rotated 90°, it will be appreciated that an inductance can be represented by a resistance and a capacitance can be represented by a negative resistance. Although there is in reality no such thing as a negative resistance, there has recently been developed a circuit that simulates the characteristics of a negative resistance. This circuit is called a frequency dependent negative resistance or "FDNR". Thus, by utilizing ordinary resistors as the series components and FDNR's as the shunt components, the present invention provides an ADL modeled vocal tract comprised of components which can be practically tuned. In the preferred embodiment described hereinafter, the vocal tract comprises five "LC" sections with four tuning elements. Thus, only four control signals are required. However, as will be appreciated by those skilled in the art, the vocal tract can be readily modified to include additional stages and additional tuning elements if desired.

Except for the vocal oscillator circuit, the balance of the present speech synthesizer is comprised entirely of digital circuitry. Thus, unlike prior art analog speech synthesizers, the present system is remarkably small in size and exceptionally inexpensive to manufacture. The speech synthesizer of the present invention is driven by a 12-bit digital input command word. Six of the bits in the input command word identify the particular phoneme to be produced, two of the bits establish the inflection level, and the remaining four input bits determine the speech rate of the audio output. The six phoneme select bits are provided to a read-only-memory (ROM) circuit that is adapted to produce a plurality of parameter control signals which electronically define the particular phoneme identified. The control signals produced can be divided into three groups: the reflection coefficient parameters, the excitation parameters, and the timing parameters. The timing parameters, along with the four speech rate input bits are provided to a timing network which controls individual phoneme timing, transition timing, and overall speech rate.

The reflection coefficient parameters, which electronically tune the vocal tract, and the excitation parameters, which control the injection of voiced and fricative excitation energy into the vocal tract as well as control the spectral shape of the speech output waveform, are provided through novel digital transition circuitry which serves to smooth the abrupt variations that occur in the values of the control signals from phoneme-to-phoneme. The transition functions in the preferred embodiment are generated by a pair of random access memory (RAM) units under the control of the timing network. More particularly, the control signal parameters from the input ROMs are generated over a predetermined time period referred to as a time "frame". Each time frame is then divided by the timing network into four binary weighted bit intervals, each comprising a predefined number of time slots. For each of the reflection coefficient and excitation control signal parameters, there is dedicated in the RAM units the appropriate number of memory address locations corresponding to the total number of time slots in the four bit intervals of the time frame. When the value of a control signal parameter changes, the new value is "written" substantially simultaneously into four memory locations at a time, corresponding to one time slot in each bit interval, at a rate determined by the timing network. Accordingly, it will be seen that when a new control signal is produced by the ROM input units indicating the beginning of the next phoneme, the appropriate address locations in the RAM transition units are gradually updated to the new value. In this manner, the control signal value produced at the output of the RAM units also changes gradually from its previous value to the new value. Thus, it will be appreciated that the present speech synthesizer accomplishes the smooth dynamic variations between phonemes that characterize human speech through the exclusive use of digital circuitry.

Additional objects and advantages of the present invention will become apparent from a reading of the following detailed description of the preferred embodiments which makes reference to the following set of drawings in which:

DETAILED DESCRIPTION OF THE PREFERRED EMBODIMENT

Figure 1:
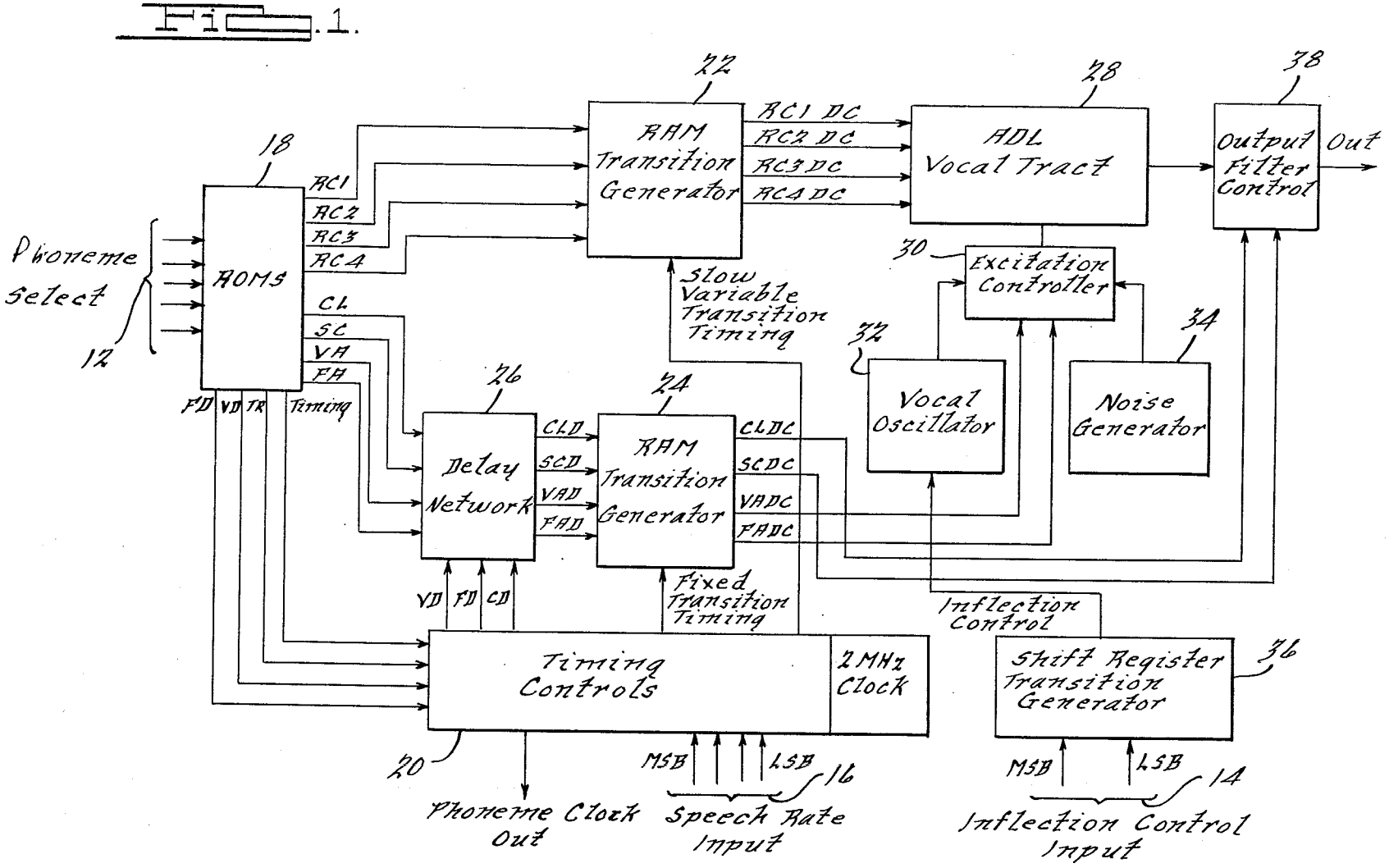
FIG. 1 is a block diagram of a speech synthesizer according to the teachings of the present invention.

Referring to FIG. 1, a block diagram of a speech synthesizer according to the present invention is shown. The system is adapted to be responsive to a 12-bit digital input command word. Six of the input bits 12 identify the particular phoneme to be generated, two of the input bits 14 establish the inflection level and the remaining four bits 16 determine the speech rate of the audio output. The six phoneme select bits 12 are provided to read-only-memory (ROM) units 18 which are adpated to produce a plurality of parameter control signals, herein twelve, which electronically define the phoneme identified by the select bits 12.

The first group of four control signal parameters referred to as reflection coefficients (RC1–RC4) serve to tune the analog delay line (ADL) vocal tract 28 in a manner to be subsequently described. The second group of control signal parameters, referred to as the excitation parameters, includes the closure (CL), spectral contour (SC), vocal amplitude (VA) and fricative amplitude (FA) control signals. The closure control signal (CL) is provided to simulate the phoneme interaction which occurs, for example, during the production of the phoneme "b" followed by the phoneme "e". In particular, the closure control signal when generated causes an abrupt amplitude modulation in the audio output that simulates the buildup and sudden release of energy that occurs during the pronunciation of such phoneme combinations. The spectral contour control signal (SC) is another control signal which also spectrally shapes the audio output signal from the vocal tract. Specifically, the spectral contour control signal controls a first order low pass filter that suppresses the high frequency end of the audio output spectrum to varying degrees for different phoneme sounds. The vocal amplitude control signal (VA) is generated whenever a phoneme having a voiced component is present, and is utilized to control the intensity of the voiced excitation signal that is injected into the vocal tract. Similarly, the fricative amplitude control signal (FS) is generated whenever a phoneme having an unvoiced component is present, and is used to control the intensity of the fricative excitation signal that is injected into the vocal tract.

The third group of control signal parameters are referred to as the timing parameters and include the phoneme timing, transition rate (TR), vocal delay (VD), and fricative delay (FD) control signals. The timing control signal is generated for each phoneme and determines the duration of the phoneme. In particular, the timing control network 20 is adapted to produce a "phoneme clock" output signal in accordance with the timing control signal, that is provided to the interface device supplying input data to the speech synthesizer to notify the device when the next 12-bit digital input command word is needed. The transition rate control signal (TR) is also generated for each phoneme, and serves to establish the transition rate between the steady-state values of the four reflection coefficient control signals (RC1–RC4). As will subsequently be explained in greater detail, the excitation parameter control signals are provided in the preferred embodiment through a fixed rate RAM transition generator 24, although the transition rate of these control signals could also be made variable under parameter control if desired. The vocal delay control signal (VD) is generated during certain fricative-to-vowel phonetic transitions wherein the amplitude of the fricative constituent is rapidly decaying at the same time the amplitude of the vocal constituent is rapidly increasing. Under such circumstances, the timing control network 20 is adapted to "tell" the delay network 26 to delay the transmission of the vocal amplitude control signal (VAD) for a time period determined by the value of the vocal delay control signal (VD). Similarly, the fricative delay control signal (FD) is generated during certain vowel-to-fricative phonetic transitions wherein it is desirable to delay the fricative amplitude control signal (FA). Specifically, the timing network 20 is adapted to "tell" the delay network 26 to delay the transmission of the fricative amplitude control signal (FAD), as well as the spectral contour control signal (SCD), for a time period determined by the value of the fricative delay control signal (FD). In addition, the timing network 20 is also adapted to produce a fixed closure delay signal (CD), although a separate parameter controlled closure delay signal could be provided if desired, that is provided to the delay network 26 to delay the transmission of the closure control signal (CLD).

The four reflection coefficient control signal parameters (RC1–RC4) and the four delayed excitation control parameters (CLD, SCD, VAD and FAD) are provided to a pair of random access memory (RAM) transition generators, 22 and 24 respectively. RAM transition generators 22 and 24 are adapted to produce gradual transitions in the values of the parameter control signals as the control signals vary from phoneme to phoneme. More particularly, each time the ROM input units 18 produce a new set of control signal parameters the RAM transition generators 22 and 24 gradually change each of the control signals to its new value over the appropriate transition period. In the case of RAM transition generator 22, this transition rate is determined by the slow variable transition timing signal generated by the timing control network 20 in accordance with the value of the transition rate control signal (TR). In the case of RAM transition generator 24, this transition rate is fixed by the fixed transition timing signal produced by the timing control network 20. However, both the variable and fixed transition timing signals generated by the timing control network, as well as the phoneme clock output signal, are all adapted to be uniformly varied in accordance with the value of the four speech rate input bits 16 in the input command word. The manner in which this is accomplished will be subsequently explained in detail in connection with the description of the circuit diagram of the present speech synthesizer system.

The four reflection coefficient control signals (RC1–RC4) from the output of RAM transition generator 22 are provided to the analog delay line (ADL) vocal tract 28. As noted previously, the vocal tract 28 in the preferred embodiment comprises a five section analog delay line having resistors as the series components and frequency dependent negative resistances as the shunt components. Although both the series and shunt components in the present ADL implementation are readily tunable, the four reflection coefficients RC1–RC4 are utilized in the preferred embodiment to tune only the series resistive components in the first four sections of the analog delay line.

Vocal excitation energy and fricative excitation energy are generated by a vocal oscillator circuit 32 and a noise generator 34, respectively. The fundamental frequency of the voiced excitation signal generated by the vocal oscillator 32 is controlled by an inflection control signal produced by a shift register transition generator 36 in accordance with the setting of the two inflection control bits 14 from the input commmand word. The shift register transition generator 36 serves the same function as the two RAM transition generators 22 and 24 by producing gradual transitions in the value of the inflection control signal as the two inflection control input bits 14 change from phoneme-to-phoneme.

The voiced excitation signal and the fricative excitation signal are combined and injected into the ADL vocal tract 28 by the excitation controller circuit 30 which modulates the amplitudes of the two excitation signals in accordance with the vocal amplitude (VA) and fricative amplitude (FA) control signals. Finally, the audio output signal from the ADL vocal tract 28 is provided to an output filter control network 38 which is adapted to spectrally shape the audio output signal in accordance with the closure (CL) and spectral contour (SC) control signals as previously described.

Turning now to FIGS. 2–8, a detailed circuit diagram of a speech synthesizer according to the present invention is shown. Since an understanding of the timing in the present circuit is essential to an understanding of the operation of the entire system, it is most beneficial to begin with a description of the timing control circuitry shown in FIG. 3. It is to be noted at the outset that the present speech synthesizer is a totally synchronous system in that the entire system is driven by a central 2 MHz MASTER CLOCK 50. The control signal parameters produced by the input ROMs, which will be described shortly, are binary weighted duty cycle signals that are generated over a period of time referred to as a "frame". Each frame is divided into four bit "intervals" referred to as the "8", "4", "2", and "1" bit intervals. The "8" bit interval comprises 64 clock pulses and is accordingly 32 μsec. in duration. The "4" bit interval comprises 32 clock pulses and is accordingly 16 μsec. in duration. The "2" bit interval comprises 16 clock pulses and is accordingly 8 μsec. in duration. And the "1" bit interval comprises 8 clock pulses and is accordingly 4 μsec. in duration. Each bit interval is in turn divided into sixteen time slots, except for the "1" bit interval which is divided into only eight time slots. Thus, it will be appreciated that each time slot in the "8" bit interval comprises four clock pulses, each time slot in the "4" bit interval comprises two clock pulses, and each time slot in the "2" and "1" bit intervals comprise one clock pulse each. The above-described breakdown of a single time frame is graphically illustrated in the timing diagram shown in FIG. 9.

Figure 3:
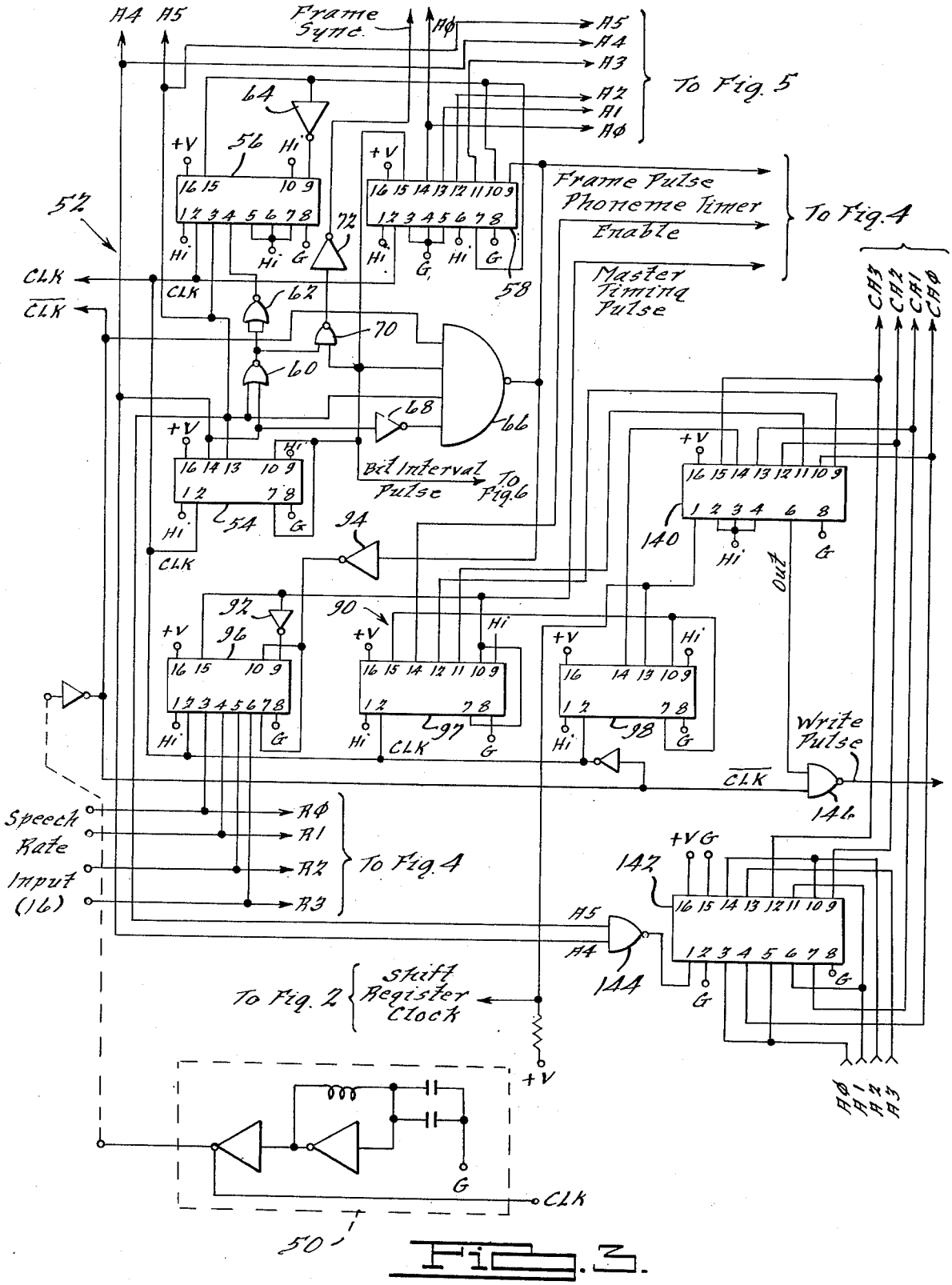
FIG. 3 is another part of the circuit diagram of the speech synthesizer shown in FIG. 1.

The time frame is generated by the master frame timing generator 52, shown in FIG. 3. The master frame timing generator 52 basically comprises three 4-bit synchronous counters 54–58. Counter 54 is a "modulus" generator or bit interval counter, counter 56 is a modulus control counter, and counter 58 is a time slot counter. Since the same type of 4-bit synchronous counter is repeatedly used throughout the present system, a brief explanation of its operation is appropriate.

The counter has four output bits, pins 11–14, with pin 14 being the LSB and pin 11 being the MSB. The counter is preset to the 4-bit number provided to its data inputs, pins 3–6, when a LOAD pulse is received at pin 9. The counter is adapted to count clock pulses provided to its clock input, pin 2, when enabled by a HI signal provided to its enable inputs, pins 7 and 10. When the counter attains a count of sixteen, a HI output pulse is produced at its "CARRY" output, pin 15. Thus, it will be appreciated that if the "CARRY" output, pin 15, of the counter is connected to the LOAD terminal, pin 9, of the counter, the counter becomes a variable modulus counter or frequency divider, with the modulus of the counter determined by the preset value. Specifically, if it is assumed for example that the four data input bits (pins 3–6) are preset to twelve, it can be seen that a HI output pulse will be produced at the CARRY output (pin 15) of the counter for every four clock pulses. In other words, assuming both enable inputs are HI, the counter will count from its preset value of 12 to 16 in four clock pulses, causing a HI pulse to be produced at the CARRY output (pin 15), which in turn loads the counter again to its preset value of twelve. (Since the counter is loaded by a logic LO pulse, it is presumed that the CARRY output signal is inverted before it is applied to the LOAD input of the counter.) Thus, the frequency of the signal at the CARRY output (pin 15) is four times slower than the clock frequency. This is referred to as a "modulus 4" counter or divide-by-four frequency divider. Similarly, it can be seen that if the data inputs (pins 3–6) were preset to fourteen, the counter would be a "modulus 2" counter or divide-by-two frequency divider. Thus, it will be appreciated that when the CARRY output (pin 15) is tied to the LOAD input (pin 9) of the counter, the modulus of the counter is determined by the formula: 16 minus the preset value of the four data inputs (pins 3–6).

Returning now to FIG. 3, it will be noted that the two LSBs (pins 13 and 14) from the output of counter 54 are provided through a NOR-gate 60 and an inverter 62 to the second least significant data input bit of counter 56. In addition, the second least significant output bit (pin 13) of counter 54 is also connected to the LSB (pin 3) in the data input to counter 56. The two MSBs (pins 5 and 6) in the data input to counter 56 are both tied HI. Initially, the two LSBs (pins 13 and 14) in the output of counter 56 are LO, therefore, counter 54 is preset to the value twelve. This indicates that the system is in the "modulus 4" or "8" bit interval in the time frame. Thus, counter 56 will count four clock pulses, from twelve to sixteen, and produce a HI pulse at its CARRY output (pin 15), which is provided to the ENABLE inputs (pins 7 and 10) of counter 58. The CARRY output (pin 15) of counter 56 is also provided through an inverter 64 to the LOAD input (pin 9) of counter 56 to reset the counter to its preset value. Since the CARRY output pulse from counter 56 is one clock pulse in duration, it can be seen that counter 58 is enabled to count every fourth clock pulse. Accordingly, as noted previously, the sixteen time slots, as determined by the count of counter 58, in the "8" bit interval are each four clock pulses in duration.

When the time slot counter 58 attains a count of sixteen (after $16 \times 4$ or 64 clock pulses), a HI signal is produced at the CARRY output (pin 15) of counter 58, which is provided to the ENABLE inputs (pins 7 and 10) of counter 54, causing the modulus generator 54 to count one clock pulse. This causes the LSB (pin 14) in the output of the counter 54 to change from a logical "0" to a logical "1", which in turn changes the preset value of the modulus control counter 56 to fourteen by setting pin 4 HI. This indicates that the system is now in the "4" bit interval of the time frame. In other words, modulus control counter 56 will now produce a CARRY output pulse every second clock pulse as the counter 56 repeatedly counts from fourteen to sixteen. Time slot counter 58 will accordingly count to sixteen after 32 clock pulses, establishing the two clock pulses per time slot in the "4" bit interval noted previously.

Upon again attaining a count of sixteen, counter 58 will produce a second CARRY output pulse which enables counter 54 to count another clock pulse. This causes the state of the two least significant output bits (pins 13 and 14) from counter 54 to change from "01" to "10", which in turn changes the preset value of counter 56 to fifteen. This indicates that the system is now in the "2" bit interval of the time frame. With the counter 56 preset to fifteen, a CARRY pulse will now be produced at pin 15 of counter 56 for each clock pulse. In other words, the "CARRY" output of counter 56 will simply state HI, thus permitting counter 58 to count every clock pulse. Accordingly, time slot counter 58 will count to sixteen in sixteen clock pulses, thereby establishing the one clock pulse per time slot in the "2" bit interval noted previously.

When the time slot counter 58 attains a count of sixteen at the end of the "2" bit interval, a CARRY pulse is once again produced at output pin 15 which is provided to the ENABLE inputs (pins 7 and 10) of counter 54. However, it will be noted at this point that the CARRY output (pin 15) of time slot counter 58 is also provided to one of the inputs of NAND-gate 66. The other inputs to NAND-gate 66 are connected to output pin 13 of counter 54 and, through an inverter 68, to output pin 14 of counter 54. Therefore, during the "2" bit interval, both of these input lines to NAND-gate 66 will be HI. The fourth input of NAND-gate 66 is tied to the $\overline{CLK}$ line to "de-glitch" the switching of the gate. Thus, since the count output (pins 13 and 14) of counter 54 does not change state until receipt of the *next* clock pulse following production of the CARRY pulse from counter 58, it can be seen that at the end of the "2" bit interval, all of the inputs to NAND-gate 66 will be momentarily HI. Accordingly, a HI pulse is produced at this point at the output of NAND-gate 66 which is referred to as the FRAME PULSE. Since the two input lines to NAND-gate 66 from output pins 13 and 14 of counter 54 are HI only during the "2" bit interval, it will be appreciated that a FRAME PULSE is produced only once each frame. (See FIG. 9).

The FRAME PULSE from the output of NAND-gate 66 is provided to the LOAD input (pin 9) of time slot counter 58, thereby presetting the counter 58 to eight. This establishes the eight time slots in the "1" bit interval noted previously. The reason for reducing the number of time slots in the "1" bit interval from sixteen to eight is to minimize the switching time requirements imposed on the RAM transition generators to be subsequently described. The bit interval counter 54 will as noted count the next clock pulse following receipt of of the CARRY pulse from counter 58, and thereby change the state of the count output at pins 13 and 14 from "10" to "11". However, due to the logic of NOR-gate 60 and inverter 62, the preset value of counter 56 will remain set at fifteen. Accordingly, the CARRY output (pin 15) of counter 56 will again remain HI, permitting the time slot counter 58 to count each clock pulse. Upon attaining a count of sixteen, after only eight clock pulses, a CARRY pulse will be produced at output pin 15 of counter 58, causing counter 54 to count another clock pulse, which switches its count output (pins 13 and 14) back to "00" to repeat the entire timing sequence.

Finally, it will be noted that only during the "8" bit interval when both of the count outputs (pins 13 and 14) of counter 54 are LO, will the output of NOR-gate 60 be HI. The output of NOR-gate 60 is provided to the input of a NAND-gate 70 which has its other input tied to the CARRY output (pin 15) of counter 58. Accordingly, it will be appreciated that at the end of the "8" bit interval when the CARRY output (pin 15) of counter 58 goes HI to enable counter 54, the output of NAND-gate 70 will momentarily go LO, which when applied through inverter 72 produces a HI output pulse referred to as the FRAME SYNC. As with the FRAME PULSE discussed above, the FRAME SYNC pulse is produced only once each frame (SEE FIG. 9).

Figure 2:
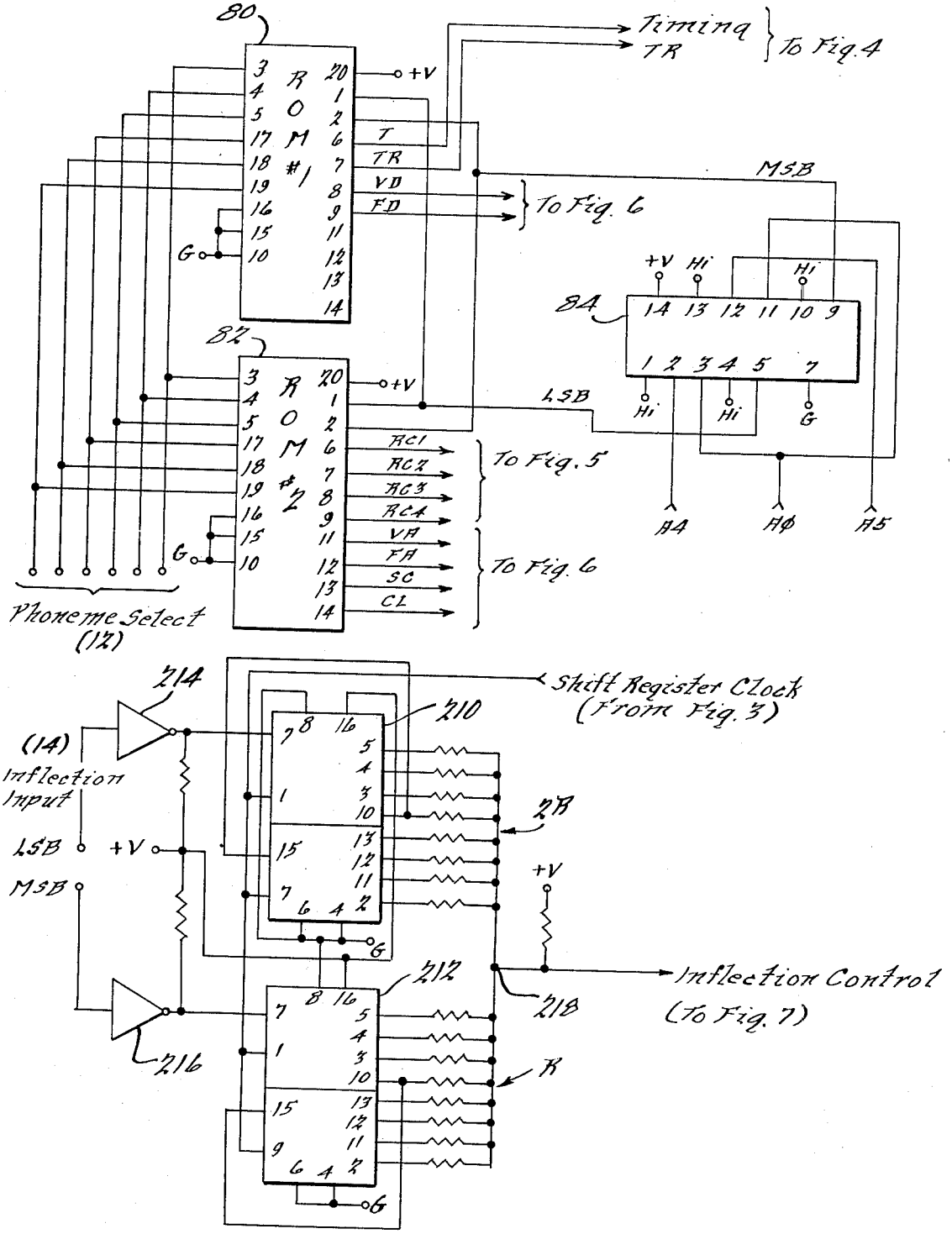
FIG. 2 is a part of a circuit diagram of the speech synthesizer shown in FIG. 1.

Turning now to FIG. 2, the generation of the control signal parameters will now be explained. The six phoneme select bits 12 in the 12-bit input command word are provided in parallel to two read-only-memory (ROM) units 80 and 82. Given the six select bits, there are $2^6$ or 64 possible phoneme selections. For each phoneme, ROM units 80 and 82 have stored therein twelve control signal values. Moreover, each control signal in the preferred embodiment has four bits of resolution or sixteen possible values; (i.e., 0–15). Accordingly, the memory capacity of the two ROMs 80 and 82 must total at least $64\times12\times4$ or 3072 bits. The ROM units 80 and 82 are adapted to produce serialized binary weighted digital control signals during each time frame period generated by the master frame timing generator 52 in FIG. 3. In particular, if for example a control signal having the value ten is to be produced, then the ROM units 80 and 82 will generate on the appropriate control signal output line a HI signal during the "8" bit interval, a LO signal during the "4" bit interval, a HI signal during the "2" bit interval, and a LO signal during the "1" bit interval. The bit intervals in the control signals produced by the ROMs 80 and 82 are, as a result of design convenience, temporally weighted. However, it will be seen that it is only important to the operation of the present system that the transitioned control signal parameters produced at the outputs of the RAM transition generators be time weighted.

The timing control for the ROM units 80 and 82 is provided by the two count output bits (pins 13 and 14) from the bit interval counter 54 in the master frame timing generator 52. In particular, the two count bit signals, designated A4 and A5, are provided to the DATA inputs (pins 2 and 11 respectively) of a pair of flip-flops contained in i.c. 84. The "Q" outputs of the two flip-flops (pins 5 and 9 respectively) comprise the LSB and MSB clock lines for the ROMs 80 and 82, and are accordingly tied to the clock inputs, pins 1 and 2, respectively, of both ROM units 80 and 82. The flip-flops 84 are clocked by the A$\phi$ signal line, which comprises the LSB in the count output of the time slot counter 58 (FIG. 3). The purpose of the flip-flops 84 is to provide a one-time-slot delay in the transmission of the A4 and A5 signals to ROMs 80 and 82. The delay is necessitated by the fact that the count output of the bit interval counter 54 changes to a new state one time slot prior to the actual beginning of the next bit interval as determined by the count output of time slot counter 58.

Figure 4:
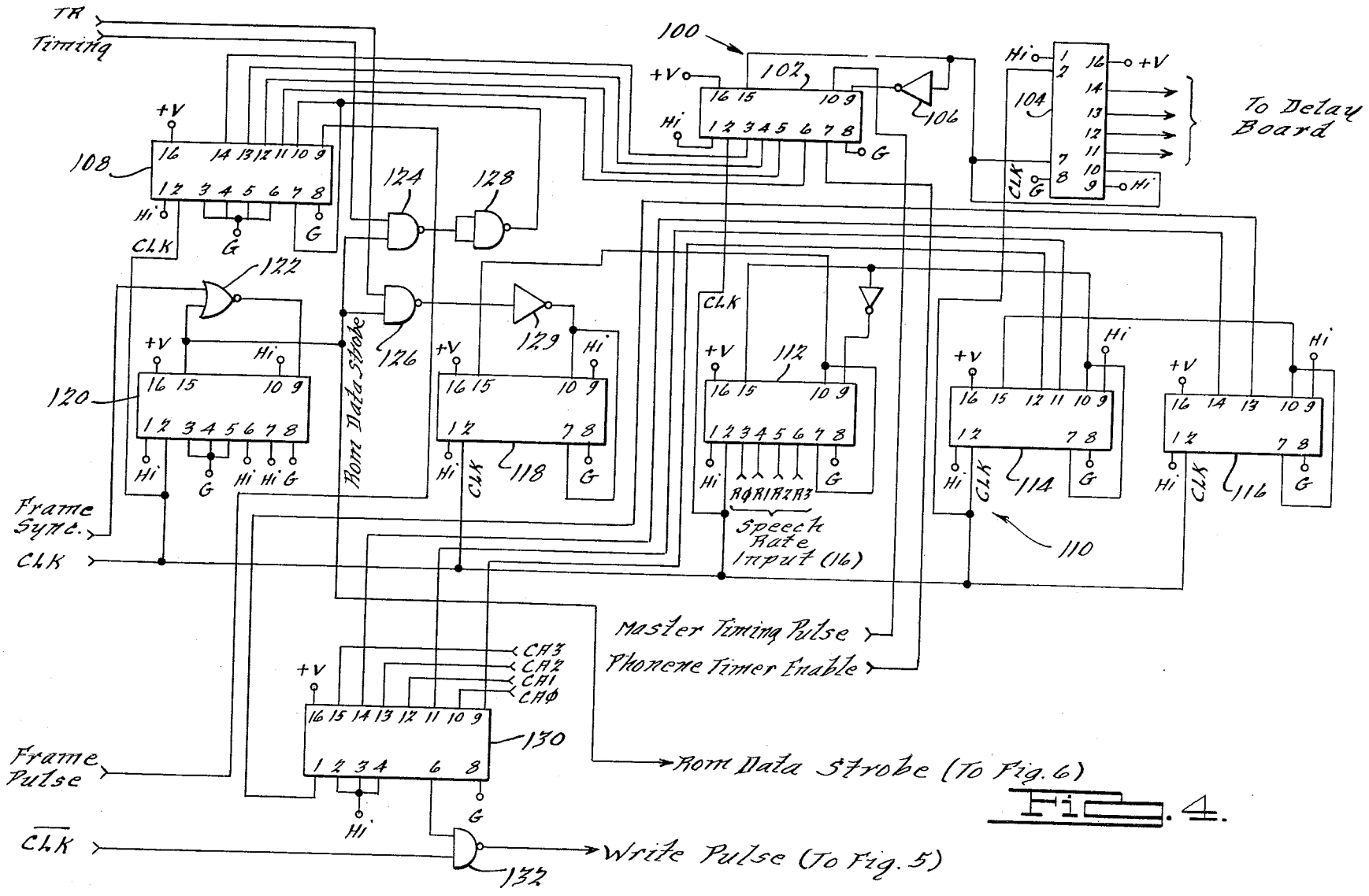
FIG. 4 is another part of the circuit diagram of the speech synthesizer shown in FIG. 1.

Returning to FIG. 3, the programmable speech rate feature of the present invention will now be explained. As noted previously, the speech rate input bits 16 control the overall speech rate of the audio output of the synthesizer, and therefore must affect not only phoneme timing but transition timing as well. The phoneme timing period is generated in the present system by a phoneme timer counter chain 100 (FIG. 4). The parameter controlled transition timing period for the reflection coefficient control signals is generated by a reflection coefficient parameter transition rate counter chain 110 (FIG. 4). The fixed transition timing period for the excitation control signal parameters is generated by an excitation parameter transition rate counter chain 90 (FIG. 3). It will be seen that the counting rates of these three counter chains, and hence the timing of the transition functions they control, are all made to vary in accordance with the value of the four speech rate input bits 16 in the input command word.

Referring to FIG. 3, the four speech rate input bits 16 are provided to the four DATA INPUT terminals (pins 3–6) of a synchronous 4-bit counter 96. The CARRY output (pin 15) of the counter 96 is tied through an inverter 92 to its LOAD input (pin 9), thus making the counter 96 a variable modulus counter with the modulus of the counter determined by the setting of the four speech rate input bits 16. The counter 96 is enabled by the FRAME PULSE produced at the output of NAND-gate 66, which is provided to the ENABLE inputs (pins 7 and 10) of counter 96 through an inverter 94 to provide the proper logic level. Therefore, since a FRAME PULSE occurs once each frame, it can be seen that the frequency of the signal produced at the CARRY output (pin 15) of counter 96 will be equal to the frame frequency divided by the modulus of the counter. Thus, for example, if the four speech rate bits are set to the value 12, then the frequency of the CARRY output signal will be four times slower than the frame frequency. Similarly, if the four speech rate bits are set to eight, then the frequency of the CARRY output signal will be eight times slower than the frame frequency. The signal produced at the CARRY output (pin 15) of counter 96 is referred to as the MASTER TIMING PULSE.

The MASTER TIMING PULSE is provided to the excitation parameter transition rate counter chain 90 to enable the counter chain. Specifically, the MASTER TIMING PULSE is provided to the ENABLE inputs (pins 7 and 10) of counter 97 whose CARRY output (pin 15) is provided to the ENABLE inputs (pins 7 and 10) of counter 98. Thus, counter chain 90 in effect comprises an 8-bit synchronous counter, although only the two least significant bits (pins 13 and 14) in the count output of counter 98 and the two most significant bits (pins 11 and 12) in the count output of counter 97 are used herein. As will subsequently be seen, the time it takes for the selected outputs of the counter chain 90 to count from zero to sixteen determines the duration of the transition period for the excitation control signal parameters. The four noted count outputs of the counter chain 90 were selected because they provide the proper transition rate for a given speech rate.

Turning now to FIG. 4, it will be noted that the MASTER TIMING PULSE is also provided to enable the phoneme timer counter chain 100. In particular, the MASTER TIMING PULSE is provided to one of the ENABLE inputs (pin 10) of counter 102 whose CARRY output (pin 15) is provided to the ENABLE inputs (pins 7 and 10) of counter 104. The CARRY output (pin 15) of counter 102 is also tied through an inverter 106 to its LOAD input (pin 9), thus making counter 102 a variable modulus counter. The modulus of counter 102 is determined by the output of counter 108 which has its four count outputs (pins 11–14) tied to the four DATA INPUTS (pins 3–6) of counter 102. Counter 108 is enabled by the output of an AND-gate, comprised of inverter 128 and NAND-gate 124, which has one of its inputs connected to the timing control signal (T) from output pin 6 of ROM 80 (FIG. 2) and its other input connected to the CARRY output (pin 15) of a divide-by-8 counter 120. The CARRY output signal from counter 120 is referred to as the ROM DATA STROBE. The ROM DATA STROBE simply comprises a fifteen pulse count over the duration of one time frame. Specifically, since there are $64+32+16+8$ or 120 clock pulses in one time frame, the clock frequency must be divided by eight to obtain a fifteen pulse count over the duration of one time frame. This is accomplished by counter 120 which has its DATA INPUTS (pins 3–6) preset to the value eight. Hence, the counter 120 continuously counts from eight to sixteen. Accordingly, the frequency of the CARRY signal from the output (pin 15) of counter 118 is eight times slower than the clock frequency. The FRAME SYNC pulse is OR'ed with the CARRY output (pin 15) of counter 120 by NOR-gate 122, whose output is connected to the LOAD input (pin 9) of the counter 120, to sychronize the ROM DATA STROBE pulse with the master frame timing generator 52.

As noted previously, the ROM DATA STROBE signal is AND'ed with the timing control signal parameter (T) by NAND-gate 124 and inverter 128. In other words, logic gates 124 and 128 will pass the ROM DATA STROBE pulses only when the logic level of the timing control signal parameter (T) is HI. Thus, if for example the timing control signal produced by ROM 80 corresponds to the value ten, then logic gates 124 and 128 will pass the ten ROM DATA STROBE pulses that appear during the "8" and "2" bit intervals when the timing control signal parameter is HI, and block the five ROM DATA STROBE pulses that appear during the "4" and "1" bit intervals when the timing control signal parameter is LO. Each ROM DATA STROBE pulse passed by logic gates 124 and 128 enables counter 108 to count one clock pulse. Accordingly, it can be seen that the count appearing at the count outputs (pins 11–14) of counter 108 after one time frame corresponds to the value of the timing control signal parameter. To synchronize its count with the master time frame generator 52, the counter 108 is loaded by the FRAME PULSE from the output of NAND-gate 66 (FIG. 2).

As also noted previously, the count output (pins 11–14) of counter 108 establishes the preset value of counter 102 which determines the modulus of the counter. Since variable modulus counter 102 is enabled by the MASTER TIMING PULSE which, it will be recalled, always occurs coincidental with the FRAME PULSE that loads counter 108, it will be appreciated that the count output (pins 11–14) of counter 108 is loaded into the DATA INPUTS (pins 3–6) of counter 102 only when the count output of counter 108 is "valid"; i.e., only after the counter 108 has completed counting the total number of ROM DATA STROBE pulses passed by NAND-gate 124 in one time frame.

Counter 102 accordingly will count one clock pulse from its preset value each time both of its ENABLE inputs (pins 7 and 10) are HI. One of the ENABLE inputs (pin 10) of counter 102 is, as noted, connected to the MASTER TIMING PULSE. The other ENABLE input (pin 7) is connected to the PHONEME TIMER ENABLE which comprises the LSB (pin 14) in the count output of counter 97 in the excitation parameter transition rate timing chain 90 (FIG. 3). It will be recalled that counter 97 is also enabled by the MASTER TIMING PULSE. Hence, the LSB (pin 14) in the count output of counter 97 will be HI only for every second MASTER TIMING PULSE. Accordingly, counter 102 is enabled to count at a rate that is half the frequency of the MASTER TIMING PULSE.

Upon attaining a count of sixteen from its preset value, counter 102 will produce a CARRY pulse at its output (pin 15) that is provided to the ENABLE inputs (pins 7 and 10) of counter 104 to enable counter 104 to count one clock pulse. This procedure will be repeated until counter 104 attains a count of sixteen. The time it takes for counter 104 to count from 0–16 establishes the time period of the phoneme.

Accordingly, it can be seen that the frequency of the CARRY signal from the output (pin 15) of counter 102 which determines the count rate of counter 104 is controlled by both the modulus of counter 102 and the frequency of the MASTER TIMING PULSE signal. Thus, since the value of the timing control signal parameter (T) determines the modulus of the counter 102 and the value of the speech rate input bits determines the frequency of the MASTER TIMING PULSE signal, it will be appreciated that the phoneme time period is made to depend on both the timing control signal parameter (T) and the speech rate input bits 16. However, it will be noted that a variation in the setting of the speech rate input bits does not alter the relative timing relationship between phonemes, but rather affects the timing of all phonemes by a uniform factor.

Figure 6:
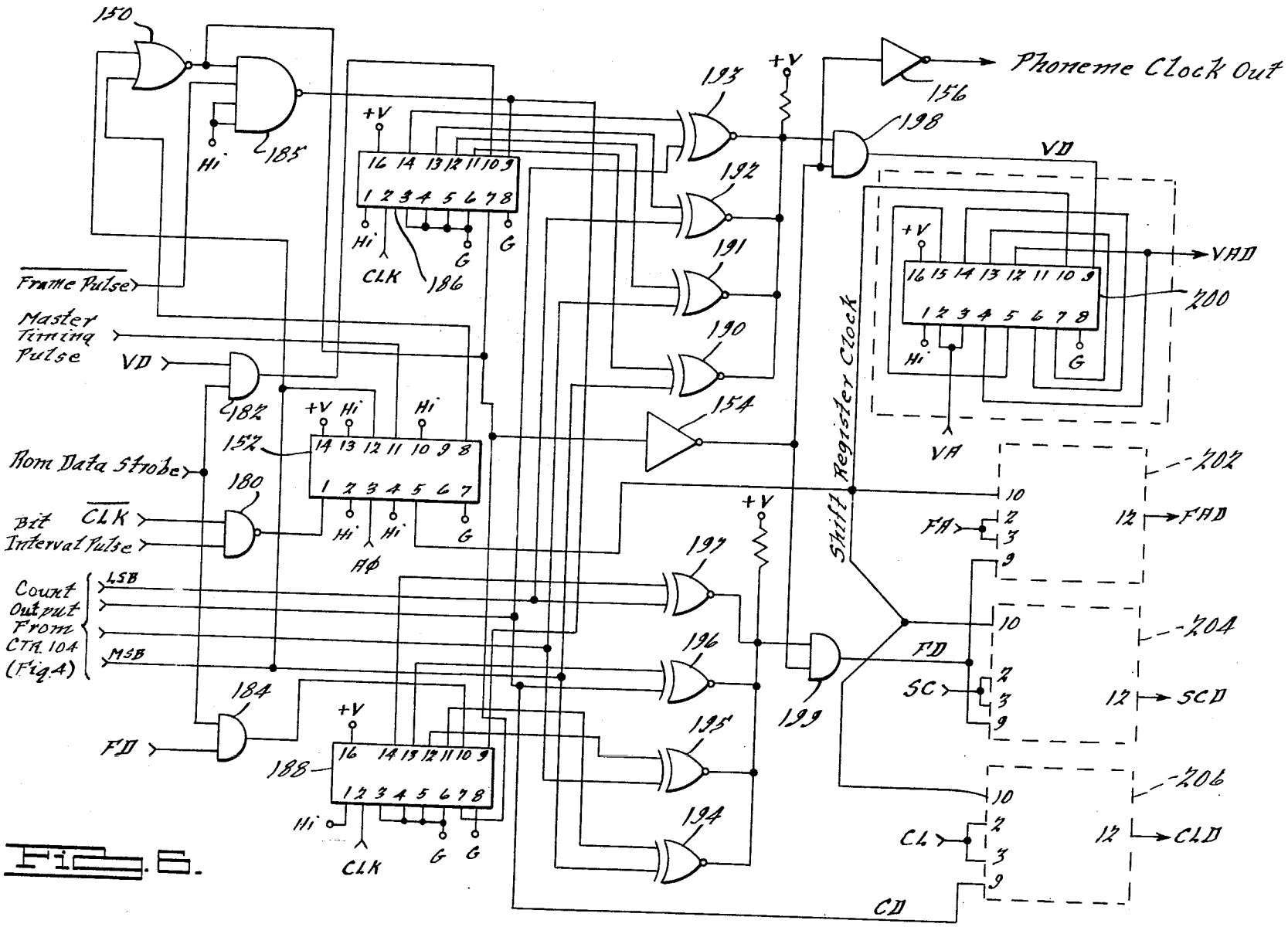
FIG. 6 is another part of the circuit diagram of the speech synthesizer shown in FIG. 1.

Referring momentarily to FIG. 6, the actual PHONEME CLOCK output pulse, which tells the "outside world" that the synthesizer is ready for the next input command word, is produced in the following manner. The MSB (pin 11) in the count output of counter 104 switches from a HI state to a LO state precisely at the end of each phoneme period. Hence, it is this logic transition that is utilized to generate the PHONEME CLOCK output pulse. The duration of the output pulse is selected to be the duration of one MASTER TIMING PULSE for convenience. More particularly, the MSB in the count output of counter 104 is provided to one input of a NOR-gate 150 and to the DATA input (pin 12) of a D-type flip-flop 152. The inverted output of the flip-flop $\overline{Q}$ (pin 8) is connected to the other input of NOR-gate 150. The flip-flop 152 is clocked by the MASTER TIMING PULSE provided to its CLOCK input (pin 11). Accordingly, the signal at the $\overline{Q}$ output (pin 8) of flip-flop 152 comprises the MSB signal in the count output of counter 104 inverted and delayed by the duration of the MASTER TIMING PULSE. NOR-gate 150 will thus produce a HI output pulse at the beginning of each phoneme period as shown in the timing diagram in FIG. 10. It will be noted, however, that the actual PHONEME CLOCK signal is taken off the output of inverter 156 after the output signal from NOR-gate 150 has been buffered for protection by inverters 154 and 156.

Returning to FIG. 4, the four speech rate input bits 16 are also provided to the DATA INPUTS (pins 3–6) of variable modulus count 112 in the reflection coefficient transition rate counter chain 110. Counter 112 is enabled by the CARRY output (pin 15) of a divide-by-16 counter 118. Counter 118 is in turn enabled by the output of an AND-gate comprised of inverter 129 and NAND-gate 126. One of the inputs to NAND-gate 126 is connected to the transition rate control signal (TR) from output pin 7 of ROM 80 (FIG. 2) and the other input is connected to the ROM DATA STROBE signal. Thus, NAND-gate 126 will pass the ROM DATA STROBE pulses that appear during the bit intervals when the transition rate control signal is HI and block the ROM DATA STROBE pulses that appear during the bit intervals when the transition rate control signal is LO. Counter 118 will accordingly produce a CARRY pulse at its output (pin 15) for each sixteen ROM DATA STROBE pulses passed by NAND-gate 126.

Each CARRY pulse produced by counter 118 will in turn enable the variable modulus counter 112 to count one clock pulse from its preset value until it attains a count of sixteen, at which point a CARRY pulse will be produced at its output (pin 15) enabling counter 114. Counter 114 is simply cascaded with counter 116, creating in effect a synchronous 8-bit counter, although only the two MSB's (pins 11 and 12) in the count output of counter 114 and the two LSB's (pins 13 and 14) in the count output of counter 116 are utilized. The count outputs of counters 114 and 116 determine the transition rate of the reflection coefficient control signal parameters. Specifically, the time it takes for the selected four count output bits from counters 114 and 116 to count from 0–16 establishes the duration of the transition period for the reflection coefficient parameters. The particular count output bits utilized were selected to provide a mid-range transition time for a nominal transition rate control signal value of seven or eight.

Accordingly, it can be seen that the frequency of the CARRY signal from the output (pin 15) of counter 112 which determines the count rate of counters 114 and 116 is controlled by the value of the transition rate control signal (TR) which determines the count rate of counter 112 and the speech rate input bits which determine the modulus of the counter 112. Thus, it will be appreciated that the transition rate for the reflection coefficient control signal parameters is controlled by both the transition rate control signal (TR) and the setting of the speech rate input bits 16. However, as with the phoneme timing counter chain 100, a variation in the setting of the speech rate input bits will affect all transition periods uniformly while maintaining relative transition timing relationships between phonemes intact.

Figure 5:
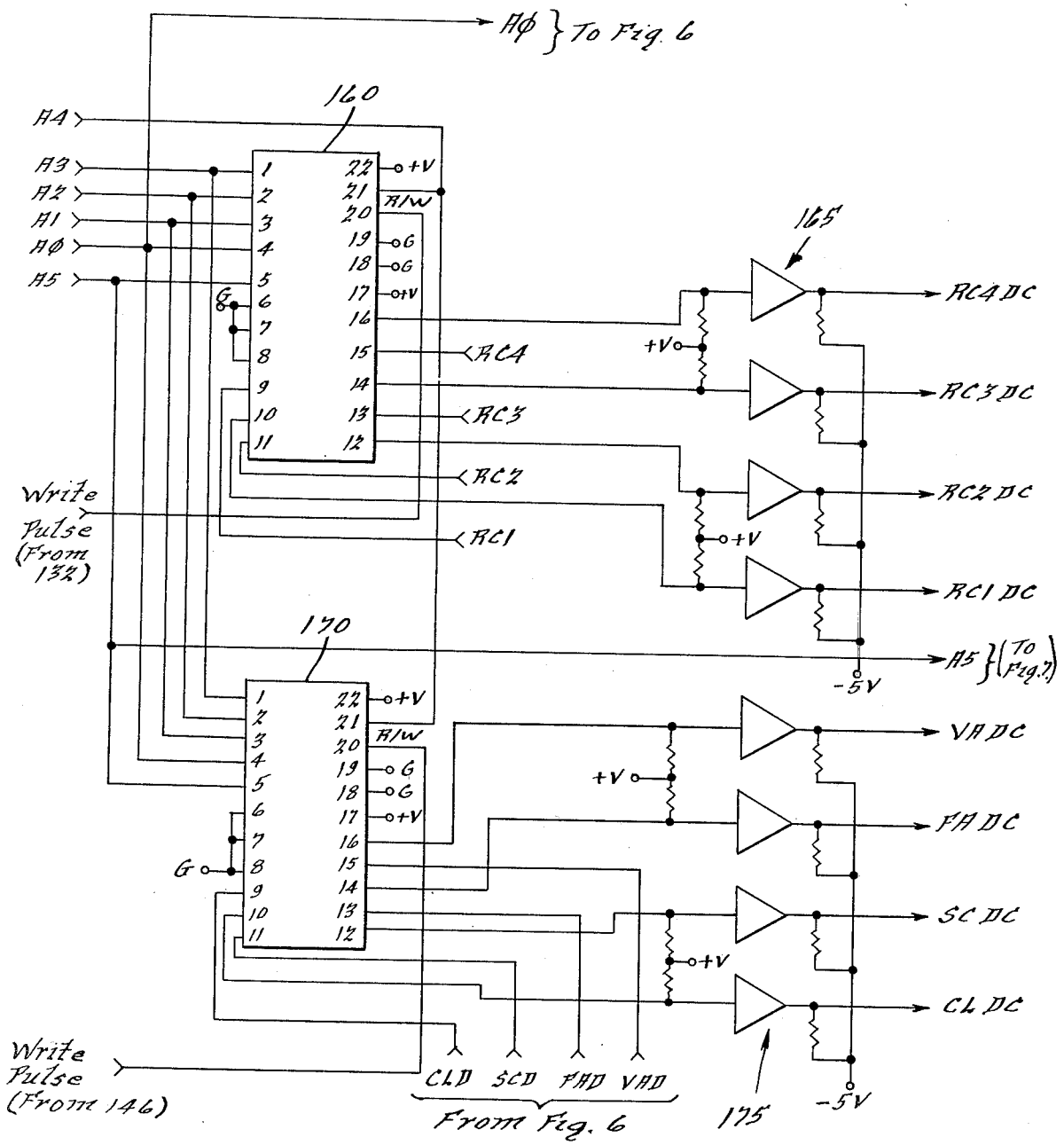
FIG. 5 is another part of the circuit diagram of the speech synthesizer shown in FIG. 1.

Turning to FIGS. 3–5, the operation of the digital transition generators will now be explained. The transitions for the eight transitioned control signal parameters are generated by the same basic method. It will be recalled that the value associated with each of the duty cycle control signals generated by ROMs 80 and 82 is equivalent to the digital state of the control signal during each bit interval in the time frame. Thus, a control signal that is for example, LO during the "8" bit interval and HI during the "4", "2", and "1" bit intervals has a value over the duration of one time frame of seven. Similarly, a control signal that is HI during the "8" bit interval, LO during the "4" and "2" bit intervals, and HI again during the "1" bit interval has a value over the duration of one time frame of nine. Consequently, the fundamental purpose of the digital transition generators is to gradually change the time frame value of each control signal from its old value to its new value over the prescribed transition period. This is accomplished in the following manner.

Figure 9:
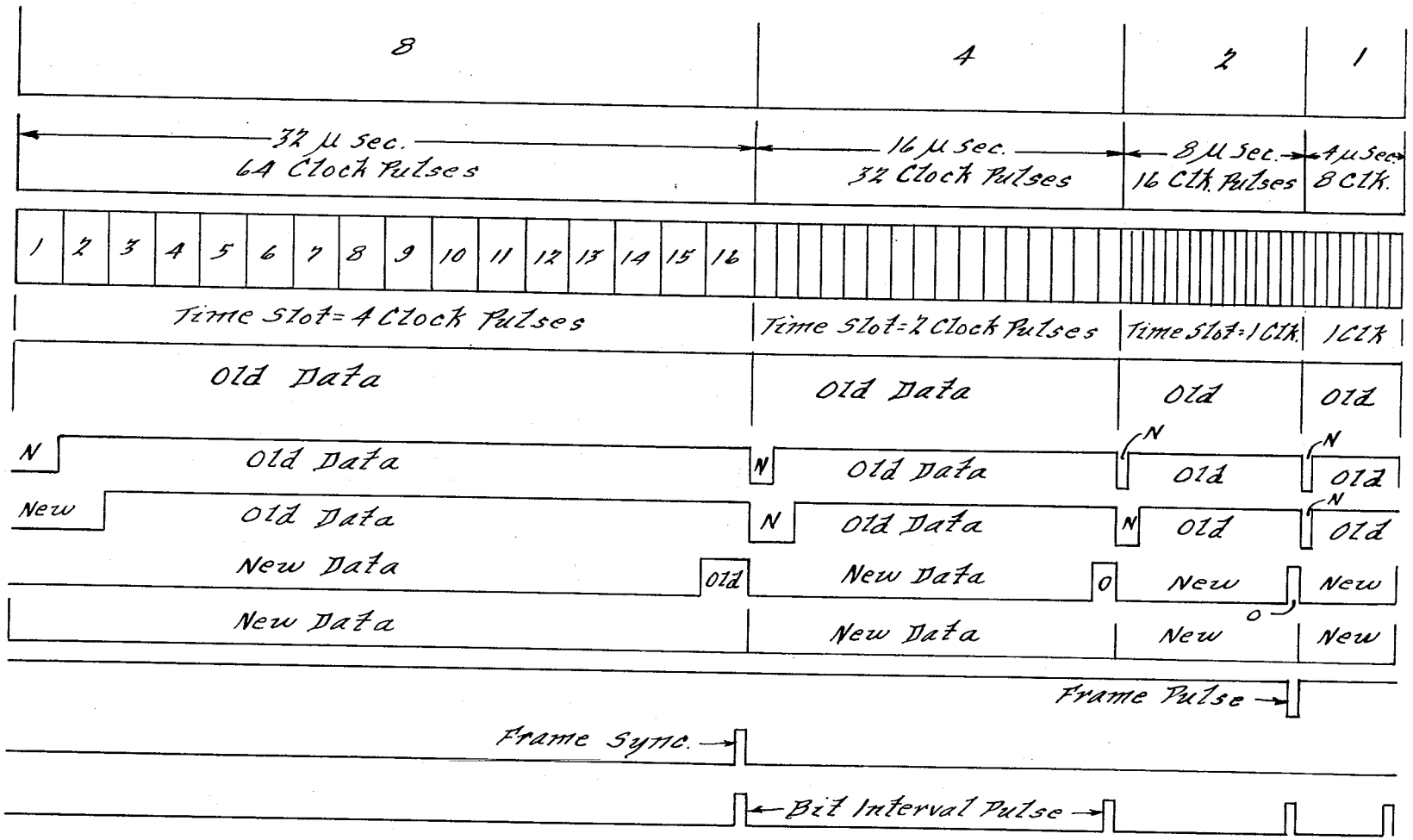
FIG. 9 is a timing diagram illustrating the relative timing sequence of selected timing signals, as well as the manner in which the transition functions of the present invention are generated.

With additional reference to FIG. 9, it will be recalled that each bit interval in the time frame is divided by counter 58 in the master frame timing generator 52 (FIG. 3) into sixteen time slots, except for the "1" bit interval which is divided into only eight time slots. Thus, for each control signal parameter, the RAM transition generators have dedicated therein 16+16+16+8 or 56 address locations corresponding to the number of time slots in one frame. Accordingly, if for example, a control signal parameter value is HI during the "8" bit interval, then the sixteen time slot address locations in the RAM transition generators corresponding to the "8" bit interval for that control signal will all be HI. Similarly, if the control signal parameter value is LO during the "1" bit interval, then the eight time slot address locations corresponding to the "1" bit interval for that control signal will be LO.

Further, it will also be recalled that the transition periods for the excitation control signal parameters and the reflection coefficient control signal parameters are both determined by the duration of 16-count counters. Specifically, in the case of the excitation control signal parameters, the transition period is governed by the selected 4-bit count output previously noted from counters 97 and 98 in the excitation parameter transition rate counter chain 90. In the case of the reflection coefficient control signal parameters, the transition period is governed by the selected 4-bit count output previously noted from counters 114 and 116 in the reflection coefficient parameter transition rate counter chain 110. Each count of these transition counters is therefore utilized to identify one time slot in each of the four bit intervals in the time frame, except again for the "1" bit interval wherein each time slot is identified by two transition counts. Thus, it will be appreciated that the average value of a control signal over the period of one time frame is gradually changed from its old parameter value to its new parameter value by simultaneously updating the data in one time slot of each bit interval for each count of the transition rate counter. In other words, as graphically illustrated in FIG. 9, the transition is generated by updating the data in the first time slot in each bit interval during the first count of the transition counter, updating the data in the second time slot in each bit interval during the second count of the transition counter, and so on until all of the sixteen time slots in each bit interval of the frame have been updated to the new value. As will subsequently be seen, this is accomplished by utilizing the output of the time slot counter 58 in the master frame timing generator 52 to access the appropriate memory address locations in the random-access memory units 160 and 170 (FIG. 5). In the "1" bit interval, of course, which has only eight time slots, a time slot is updated only every other count of the transition rate counter.

It will be noted at this point that for a control signal to completely attain its new parameter value, the time period of the new phoneme must be longer than the transition period, which is not always the case. When this situation occurs, the new parameter value simply will not be fully attained but instead will begin to change from whatever value is attained during the phoneme period to the new parameter value of the next phoneme. However, the operating principals of the transition generators in both instances are the same.

Returning to the circuit diagram, the implementation of the above-described transition for the reflection coefficient and excitation control signal parameters will now be explained. As will be appreciated from the following description by those skilled in the art, the transition generator function performed by the random-access memory units 160 and 170 in the preferred embodiment herein could also be implemented utilizing a plurality of 56-bit recirculating shift registers. The four count output bits (A$\phi$–A3) from the time slot counter 58, as well as the two LSBs (A4 and A5) from the count output of the bit interval counter 54, are provided to the address inputs of a pair of random-access memory (RAM) units 160 and 170. It will be appreciated that the six signal lines A$\phi$–A5 uniquely identify each time slot in the time frame. Specifically, lines A4 and A5 identify the bit interval and lines Aϕ–A3 identify the particular time slot within the bit interval. The four time slot bits Aϕ–A3 are also provided through a multiplexer 142 to one set of inputs to each of a pair of 4-bit digital comparators 140 (FIG. 3) and 130 (FIG. 4). The four bits from the output of multiplexer 142 are designated CAϕ–CA3. For the present, it will be presumed that Aϕ–A3 are equal to CAϕ–CA3, respectively. The other set of inputs to comparator 140 is connected to the selected four count output bits (pins 11 and 12 of counter 97 and pins 13 and 14 of counter 98) from the excitation parameter transition rate counter chain 90 which determine the transition rate of the excitation parameters. Similarly, the other set of inputs to comparator 130 is connected to the selected four count output bits (pins 11 and 12 of counter 114 and pins 13 and 14 of pins 116) from the reflection coefficient parameter transition rate counter chain 110 which determine the transition rate of the reflection coefficient parameters. Comparators 130 and 140 are adapted to produce an output signal at pin 6 thereof whenever the two 4-bit signals provided to their respective inputs are equal.

The output signal (pin 6) from comparator 140 is provided through a NAND-gate 146 to the READ/-WRITE input (pin 20) of RAM 170. Similarly, the output signal (pin 6) from comparator 130 is provided through another NAND-gate 132 to the READ/-WRITE input of RAM 160. The other inputs of both NAND-gates 132 and 146 are tied to the $\overline{CLK}$ line to "de-glitch" the WRITE PULSES provided to the RAMs 160 and 170. The four data inputs (pins 9, 10, 13 and 15) of RAM 160 are connected to receive the four reflection coefficient control signal parameters (RC1–RC4) generated by ROM 82. Similarly, the four data inputs (pins 9, 10, 13 and 15) of RAM 170 are connected to receive the four excitation control signal parameters (CLD, SCD, FAD, and VAD) generated by ROM 82 and delayed by the delay network (FIG. 6) to be subsequently described. RAMs 160 and 170 are adapted, upon receipt of a WRITE PULSE, to write into the address locations identified by the address inputs Aϕ–A5 the data present on their data input lines. In particular, the Aϕ–A5 address bits actually identify one memory address location for each of the four data inputs, so that data from each of the four input lines is simultaneously written into the Aϕ–A5 address location associated with its particular data input.

As previously noted, for each of the eight aforementioned control signal parameters, the RAM units 160 and 170 have dedicated therein fifty-six address locations corresponding to the number of time slots in one frame. Thus, when the count output of transition rate counters 114 and 116, for example, is equal to 0001, it can be seen that comparator 130 will provide a WRITE PULSE to RAM 160 during the first time slot in each of the four bit intervals; i.e., each time the count output of counter 58 is also equal to 0001. Accordingly, the data present on the four input lines (RC1–RC4) to RAM 160 during these time slots will be written into the appropriate memory locations in RAM 160. In other words, four of the fifty-six address locations dedicated in RAM 160 for each reflection coefficient control signal parameter will be updated with new data during each count of the transition rate counters 114 and 116. Since it takes only approximately 50 μsec. to update the time slot in each of the four bit intervals, in relation to the speech rate output, this occurs substantially simultaneously. Moreover, since the frame frequency may be many times faster than the transition rate count frequency, it can be seen that the same "new" data may be rewritten into the same four address locations over and over again until the transition rate counters are incremented. Accordingly, it will be appreciated that after the transition rate counters 114 and 116 have counted to sixteen, each of the fifty-six address locations in RAM 160 associated with each of the four reflection coefficient control signal parameters will have been updated with new data. Of course, the values of the excitation control signal parameters are updated in RAM 170 in the identical manner.

An exception to the above-described circuit operation occurs during the "1" bit interval of each frame. During the "8", "4" and "2" bit intervals, the multiplexer 142 simply passes the time slot outputs Aϕ–A3 to the inputs of the comparators 130 and 140; i.e., bits CAϕ–CA3 equal bits Aϕ–A3, respectively. However, during the "1" bit interval there are only eight time slots, and accordingly eight address locations in RAMs 160 and 170, to be updated with new data. Thus, it can be seen that new data must be written into RAMs 160 and 170 twice as slow during the "1" bit interval as compared to the "8", "4" and "2" bit intervals. In other words, one of the eight time slots in the "1" bit interval must be updated for every two updated time slots in each of the "8", "4" and "2" bit intervals. This is accomplished through the use of multiplexer 142 which simply comprises a 4-pole, two-position switch. The two sets of 4-bit inputs (pins 2, 5, 11 and 14 and pins 3, 6, 10 and 13) to multiplexer 142 are connected to the four time slot counter outputs Aϕ–A3 in such a fashion so that when the select input (pin 1) to multiplexer 142 is HI, CAϕ=Aϕ, CA1=A1, CA2=A2, and CA3=A3, and when the select input (pin 1) is LO, CAϕ=0, CA1=Aϕ, CA2=A1, and CA3=A2. Thus, it can be seen that during the "1" bit interval when both the A4 and A5 signals from pins 13 and 14 of the bit interval counter 54 are HI, the output of NAND-gate 144 will go LO, thereby causing the four multiplexer outputs CAϕ–CA3 to "shift" one bit position to the left relative to the four time slot counter bits Aϕ–A3. In other words, during the "1" bit interval, the LSB CAϕ from the output of multiplexer 142 is set to zero so that a comparison with the outputs of the transition rate counters will be made by comparators 130 and 140 only during the even counts of the transition counters; i.e., only when the LSB from the transition counters is also equal to zero. Thus, it will be appreciated that WRITE PULSES from the two comparators 130 and 140 will only be produced for every second count of the transition rate counters during the "1" bit interval of the frame.

With particular reference to FIG. 5, the eight parameter output signals from the two RAM units 160 and 170 are provided to a series of level shifters 165 and 175 respectively, which convert the 0–5 volt duty cycle signals from the RAM outputs to bipolar ±5 volt duty cycle signals which are required to drive the analog control gates in the vocal tract, excitation controller, and output filter control circuits. It is important to note at this point that the RAM transition units 160 and 170 are adapted to produce time-weighted duty cycle output signals. In particular, since the READ/WRITE inputs (pin 20) to both RAM units 160 and 170 are HI virtually all of the time (except for the occasional brief appearance of a LO WRITE PULSE), the data in the RAM addresses accessed by the input address lines Aϕ–A5 is read from the RAMs 160 and 170 almost continuously. Accordingly, it will be appreciated that the duration for which any given bit of data contained in RAMs 160 and 170 is read onto a data output line thereof will depend upon the period of time that the memory address of that particular bit of data appears on the RAM address input lines Aϕ–A5. Thus, since the bit interval (A4 and A5) and time slot (Aϕ—A3) counter outputs which address the RAM units 160 and 170 are time-weighted (FIG. 9), the data outputs of RAMs 160 and 170 will also be time-weighted accordingly. Hence, the reflection coefficent and excitation control signal parameters produced at the outputs of RAMs 160 and 170 comprise time-weighted digital duty cycle signals.

Turning now to FIG. 6, the operation of the delay network will now be explained. As generally noted in connection with the description of the block diagram of the present system shown in FIG. 1, the delay network is adapted to delay the transmission of the four excitation control signal parameters in accordance with the vocal delay (VD) and fricative delay (FD) control signals. The values of the delay parameters in relation to the phoneme time period determine the duration of the delays. In particular, if for example the vocal delay parameter (VD) is set to the value eight, then the vocal amplitude control signal (VA) will be delayed for one half of the phoneme time period. Similarly, if the vocal delay parameter (VD) is set to the value four, then the vocal amplitude control signal (VA) will be delayed for one fourth of the phoneme time period, and so forth. The delay of the excitation control signal parameters is accomplished as follows. The vocal delay (VD) and fricative delay (FD) control signals from the outputs (pins 8 and 9 respectively) of ROM 80 are each provided to the input of an AND-gate, 182 and 184 respectively. The other input of both AND-gates 182 and 184 is tied to the ROM DATA STROBE signal line from the CARRY output of counter 120 in FIG. 4. The ROM DATA STROBE signal, it will be recalled, merely comprises a signal whose frequency is fifteen times the frame frequency. Accordingly, it can be seen that AND-gates 182 and 184 will pass ROM DATA STROBE pulses only when the vocal delay (VD) and fricative delay (FD) control signals, respectively, are HI. The outputs from AND-gates 182 and 184 are each provided to one of the ENABLE inputs (pin 10) of a counter, 186 and 188 respectively. Counters 186 and 188 are preset to zero by the FRAME PULSE which is provided to the LOAD input (pin 9) of both counters through a NAND-gate 185. Thus, it will be appreciated that counters 186 and 188 will count the number of ROM DATA STROBE pulses passed by AND-gates, 182 and 184 respectively, during one frame period. Hence, the control signal values of the vocal delay (VD) and fricative delay (FD) parameters are extracted in the same manner as that previously described in connection with the timing control signal (T) in the circuit shown in FIG. 4. It will also be noted that the PHONEME CLOCK pulse from the output of NOR-gate 150 is provided to the other ENABLE input (pin 7) of both counters 186 and 188 to insure that the counters "hold" the accumulated ROM DATA STROBE pulse count for one time frame. Specifically, it will be recalled that the PHONEME CLOCK signal is HI for the duration of one MASTER TIMING PULSE at the beginning of each phoneme period. Therefore, since the period of one MASTER TIMING PULSE is equal to one or more FRAME PULSES, depending upon the speech rate input, it can be seen that the counters 186 and 188 will be disabled precisely at the end of a FRAME PULSE when the count outputs of the counters are valid.

Each of the four count output bits (pins 11–14) from counter 186 is provided to the input of an exclusive-NOR-gate, 190–193 respectively. Similarly, the four count output bits (pins 11–14) from counter 188 are each provided to the inputs of another set of exclusive-NOR-gates, 194–197 respectively. The four count output bits (pins 11–14) from the phoneme time counter 104 (FIG. 4) are provided in parallel to the other inputs of both sets of exclusive-NOR-gates, 190–193 respectively, and 194–197 respectively. Phoneme time counter 104, it will be recalled, divides the period of each phoneme into sixteen time segments. The outputs from the first set of exclusive-NOR-gates 190–193 are tied in common to +5 volts and to the input of an AND-gate 198. Similarly, the outputs from the second set of exclusive-NOR-gates 194–197 are also tied in common to +5 volts and to the input of another AND-gate 199. Hence, it will be appreciated that the two sets of exclusive-NOR-gates, 190–193 and 194–197, act as 4-bit comparators and provide HI output signals to AND-gates, 198 and 199 respectively, only when each of the four count outputs (pins 11–14) of the phoneme time counter 104 are equal to the four count outputs (pins 11–14) from counters 186 and 188, respectively. In other words, both sets of exclusive-NOR-gates 190–193 and 194–197 are adapted to produce HI output signals only after the prescribed portions of the phoneme time period, as determined by the values of the vocal delay (VD) and fricative delay (FD) control signal parameters, respectively, have past.

The output from AND-gate 198 is provided to the SHIFT/LOAD input (pin 9) of the vocal amplitude delay shift register 200. Similarly, the output from AND-gate 199 is provided to the SHIFT/LOAD inputs (pin 9) of both the fricative amplitude delay and spectral contour delay shift registers 202 and 204. The other inputs of both AND-gates 198 and 199 are tied to the inverted PHONEME CLOCK signal from the output of inverter 154. Since the non-inverted PHONEME CLOCK signal is used to enable counters 186 and 88, it can be seen that AND-gates 198 and 199 are disabled while counters 186 and 188 are counting. This serves to prevent any erroneous HI pulses from the outputs of exclusive-NOR-gates 190–193 and 194–197, which may occur while counters 186 and 188 are counting, from improperly shifting new data into shift registers 200–204. Thus, only after the count outputs of counters 186 and 188 are valid will AND-gates 198 and 199 pass the vocal delay (VD) and fricative delay (FD) output signals from exclusive-NOR-gates, 190–193 and 194–197 respectively.

Since the four delay shift registers 200–206 all operate in the same manner, only the vocal amplitude delay shift register 200 will be explained in detail. Shift register 200 comprises a 4-bit parallel access shift register having serial inputs (pins 2 and 3), parallel inputs (pins 4–7) and parallel outputs (pins 12–15). Parallel loading of the shift register 200 is accomplished when the SHIFT/LOAD input (pin 9) is LO. Shifting serial data into the shift register 200 is accomplished synchronously when the SHIFT/LOAD input (pin 9) is HI. The serial inputs (pins 2 and 3) of shift register 200 are connected to receive the vocal amplitude (VA) control signal parameter from the output (pin 11) of ROM 82 (FIG. 2). The parallel inputs (pins 4–7) of shift register 200 are connected to its parallel outputs (pins 12–15), shifted one bit position to the right, so that $A_{out}$ (pin 15) is connected to $B_{in}$ (pin 5), $B_{out}$ (pin 14) is connected to $C_{in}$ (pin 6), $C_{out}$ (pin 13) is connected to $D_{in}$ (pin 7), and $D_{out}$ (pin 12) is connected to $A_{in}$ (pin 4). In this manner, when pin 9 is LO, each time a clock pulse is received at pin 10 which causes the data appearing on the parallel inputs (pins 4–7) to be loaded onto the parallel outputs (pins 12–15), the four data output bits are shifted one bit position to the right with the end bit being returned to the first bit position. Thus, it can be seen that when the SHIFT-/LOAD line (pin 9) is LO, the shift register 200 is connected to operate as a recirculating shift register. When the SHIFT/LOAD line (pin 9) goes HI, the new data appearing on the vocal amplitude (VA) control signal line at serial input pins 2 and 3 is shifted synchronously into the shift register one bit position per clock pulse.

The shift register 200 is clocked by the BIT INTERVAL PULSE from the CARRY output (pin 15) of the time slot counter 58 in the master frame timing generator 52 (FIG. 3), delayed by one time slot. In particular, it will be recalled that the BIT INTERVAL PULSE from the CARRY output (pin 15) of time slot counter 58 is produced during the last time slot at the end of each bit interval in the time frame (FIG. 9). Accordingly, in order for the BIT INTERVAL PULSE to occur precisely at the beginning of each bit interval, it is necessary to delay the BIT INTERVAL PULSE for the duration of one time slot. This is accomplished by providing the BIT INTERVAL PULSE signal through a NAND-gate 180 to the CLEAR input (pin 1) of a D-type flip-flop 152. The other input of NAND-gate 180 is connected to the $\overline{\text{CLOCK}}$ line to "de-glitch" the BIT INTERVAL PULSE signal. The DATA input (pin 2) of flip-flop 152 is tied to +5 volts and its CLOCK input (pin 3) is connected to the LSB (A$\phi$) from the count output (pin 14) of the time slot counter 58. With the CLEAR input (pin 1) of the flip-flop continuously clamped HI except upon the occurrence of a BIT INTERVAL PULSE, it can be seen that the signal at the Q output (pin 5) of the flip-flop 152 is equivalent to the BIT INTERVAL PULSE signal delayed by the period of the flip-flop clock signal (A$\phi$); i.e., one time slot. Accordingly, the SHIFT REGISTER CLOCK signal provided to the CLOCK inputs (pin 10) of shift registers 200–206 is adapted to clock the shift registers at the beginning of each bit interval in the time frame. Thus, it will be appreciated that the delay vocal amplitude control signal parameter (VAD) produced at the output (pin 12) of shift register 200 comprises a time-weighted duty cycle signal similar to that produced by RAMs 160 and 170. Moreover, it will further be appreciated that the VAD control signal is equivalent to the VA control signal delayed for a fraction of the phoneme time period determined by the value of the vocal delay (VD) control signal.

In a similar manner, the delayed fricative amplitude control signal (FAD) produced at the output of shift register 202 is equivalent to the fricative amplitude (FA) control signal delayed for a friction of the phoneme time period determined by the value of the fricative delay (FD) control signal. Likewise, the delayed spectral contour control signal (SCD) produced at the output of shift register 204 is equivalent to the spectral contour control signal (SC) delayed for a fraction of the phoneme time period determined by the value of the fricative delay (FD) control signal. In addition, the delayed closure control signal (CLD) produced at the output of shift register 206 is equivalent to the closure control signal (CL) delayed for a fixed fraction (CD) of the phoneme time period determined by the second LSB (pin 13) from the count output of the phoneme timer 104.

It should be noted at this point that a separate spectral contour delay control signal could be provided if desired, however it has been found that the duplicative use of the fricative delay (FD) control signal to control the delay of both the fricative amplitude (FA) and spectral contour (SC) control signals produces acceptable results. Moreover, the closure delay (CD) control could also be made variable or parameter controlled if desired, however the arrangement disclosed has been found to produce desirable results without the additional complexity.

Returning to FIG. 2, the operation of the transition circuitry for the inflection control signal will now be explained. The two inflection control bits 14 from the 12-bit input command word are each provided through an inverter 214 and 216 to the serial input (pin 7) of an 8-bit serial in/parallel out shift register, 210 and 212 respectively. The eight parallel outputs (pins 2–5 and 10–13) from the LSB shift register 210 are each tied to a common junction 218 through a common valued resistor 2R. Similarly, the eight parallel outputs (pins 2–5 and 10–13) from the MSB shift register 212 are each tied to junction 218 through a common valued resistor R. In order to provide the proper binary weighting of the outputs from the two shift registers 210 and 212, the value of resistors 2R is twice the value of resistors R. Accordingly, it can readily be seen that the signal present at junction 218 comprises an analog signal whose magnitude is proportional to the 16-bit parallel digital output from shift registers 210 and 212.

Both shift registers 210 and 212 are clocked by a common shift register clock signal which is taken off the MSB (pin 13) in the count output of the excitation parameter transition rate counter chain 90 (FIG. 3). The count rate of the output from the excitation parameter transition rate counter chain 90, it will be recalled, varies in accordance with the setting of the four speech rate input bits 16. Accordingly, it will be appreciated that the frequency of the shift register clock signal, and hence the transition rate for the inflection control signal, is dependent upon the four speech rate input bits in the 12-bit input command word. The MSB (pin 13) in the count output of the excitation parameter transition rate counter chain 90 was selected as the shift register clock signal because it provides the proper transition rate for a given speech rate setting.

Figure 10:
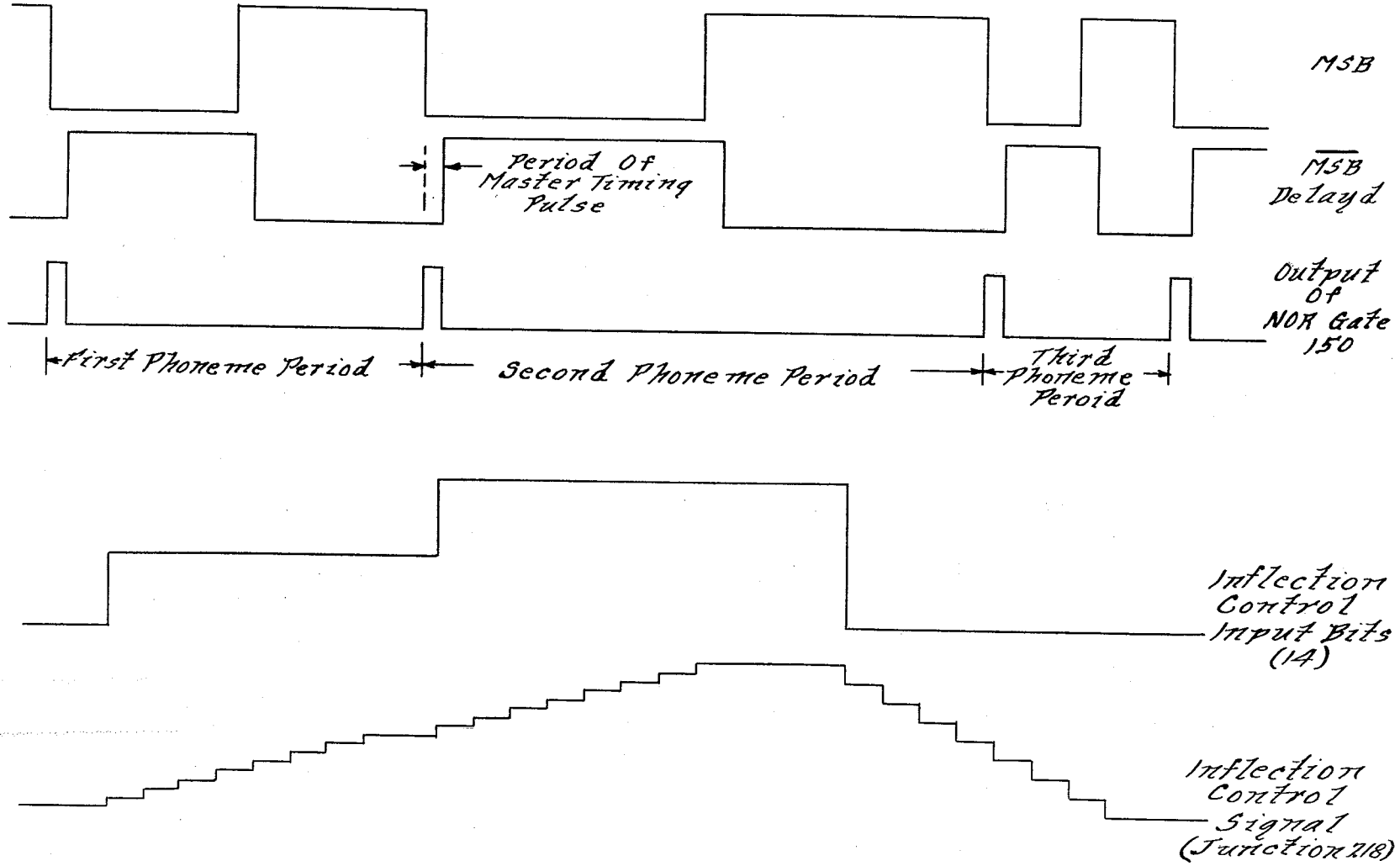
FIG. 10 is another timing diagram illustrating the manner in which the phoneme clock signal is generated, as well as the transition function for the inflection control signal.

Thus, as illustrated in the diagram shown in FIG. 10, a change in the setting of the two inflection control input bits 14 results in a corresponding change in the magnitude of the inflection control signal at junction 218 over a period of eight shift register clock pulses as the new input data is shifted synchronously into the shift registers 210 and 212. Consequently, it can be seen that the shift registers 210 and 212 provide an 8-stage transition to smooth the abrupt changes in the value of the inflection control input bits 14 that occur from phoneme to phoneme.

Figure 7:
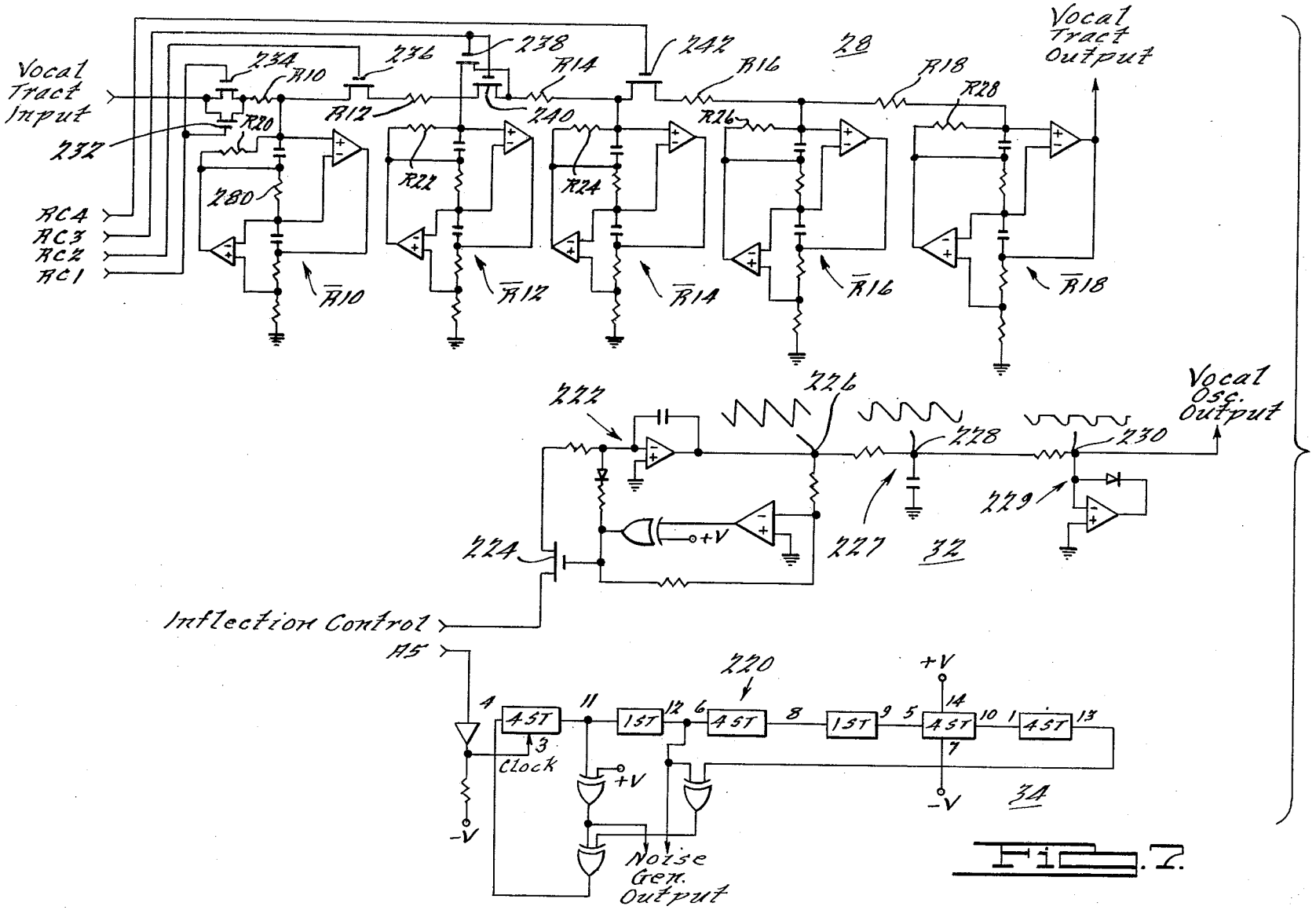
FIG. 7 is another part of the circuit diagram of the speech synthesizer shown in FIG. 1.
Figure 8:
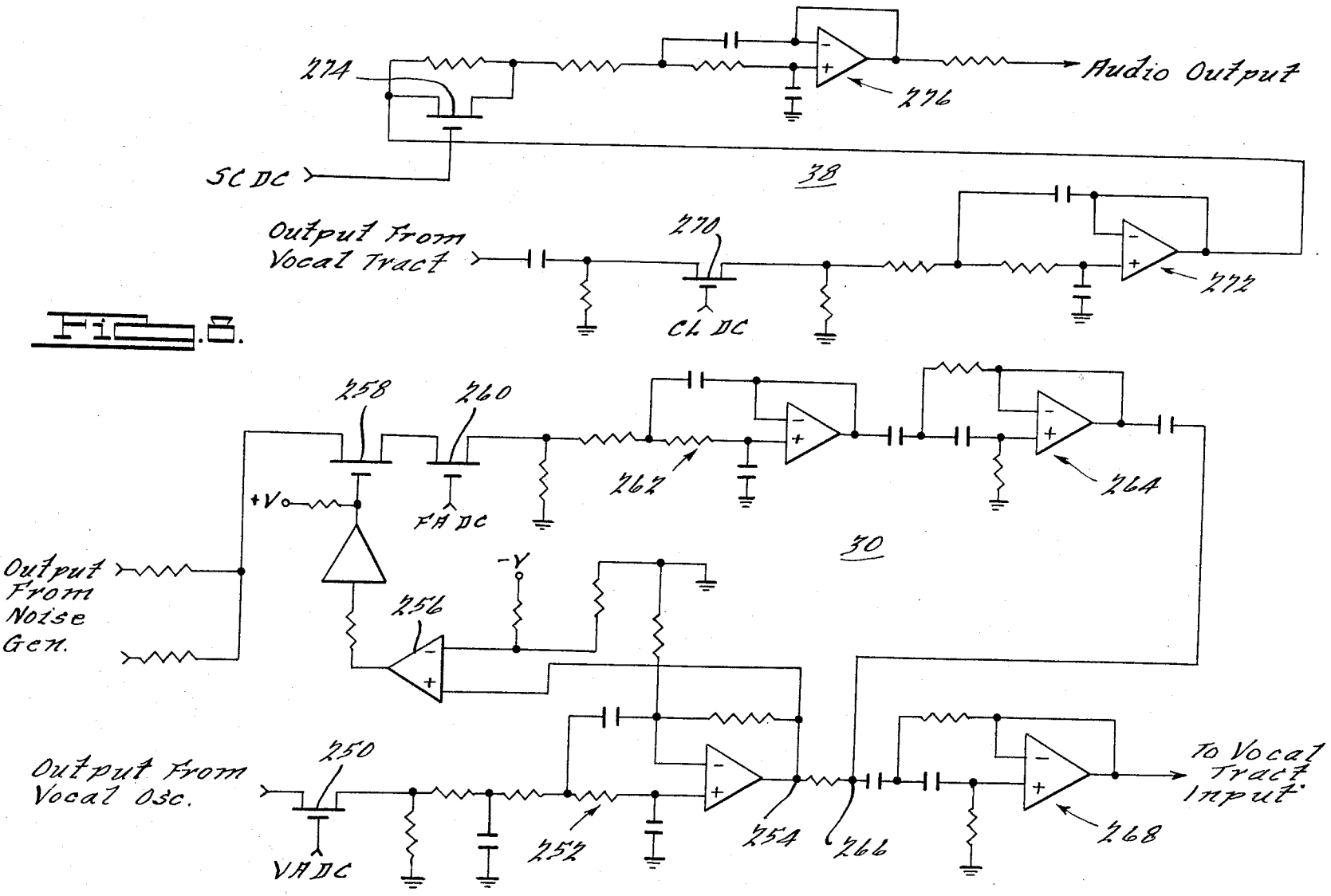
FIG. 8 is another part of the circuit diagram of the speech synthesizer shown in FIG. 1.

Turning now to FIG. 7, the vocal oscillator 32 and the noise generator 34 of the present system will now be explained. The noise generator 34 simply comprises an 18-stage shift register 220 that is connected as shown to provide a psuedo-random white noise source. The shift register 220 is clocked by the A5 signal from the count output (pin 13) of the bit interval counter 54 in the master frame timing generator 52 (FIG. 3). The A5 signal was selected simply because it is at the appropriate frequency. The output from the noise generator 34 comprises the fricative or unvoiced excitation source signal and is provided to the excitation controller circuit 30 shown in FIG. 8.

The vocal oscillator circuit 32 comprises a sawtooth generator 222 that is adapted to produce a sawtooth type waveform as shown at its output 226. The inflection control signal from the output of the transition shift registers 210 and 212 (FIG. 2) is provided to the input of the sawtooth generator 222 through an analog gate 224. The control terminal of the analog gate 224 is tied to the feedback loop of the generator 222. Accordingly, the slope of the negative-going portion of the sawtooth waveform produced by generator 222 is varied in accordance with changes in the value of the inflection control signal. Thus, it can be seen that the frequency of the sawtooth waveform, and hence the fundamental frequency (fo) of the glottal pulse is controlled by the value of the inflection control signal.

The sawtooth waveform from the output of generator 222 is provided through a filter 227 to produce the slightly rounded waveform shown at node 228. The signal from filter 227 is then truncated by a half-wave rectifier 229, thereby producing the waveform shown at node 230. The resulting signal at node 230 comprises the vocal or voiced excitation signal that is provided to the excitation controller circuit 30 shown in FIG. 8. Thus, as will be appreciated by those skilled in the art, the glottal waveform produced by the vocal oscillator circuit 222 of the present invention closely resembles the appearance of an actual human glottal pulse Referring now to FIG. 8, the voiced excitation signal from the output of the vocal oscillator circuit 222 is provided to an analog gate which has its control terminal connected to the vocal amplitude (VA) duty cycle signal produced at the output (pin 16) of the RAM transition generator 170 (FIG. 5). Since the duty cycle frequency of the vocal amplitude (VA) duty cycle signal is several times faster than the frequency components of the voiced excitation signal, it will be appreciated that the effective amplitude of the voiced excitation signal is modulated by analog gate 250 in accordance with the duty cycle of the vocal amplitude (VA) control signal. The amplitude modulated vocal source signal from the output of analog gate 250 is then provided through a third order low-pass filter network 252 to remove any unwanted high frequency content in the signal.

The fricative excitation signal from the output of noise generator 34 is provided through a first analog gate 258 to a second analog gate 260 which has its control terminal connected to the fricative amplitude (FA) duty cycle signal produced at the output (pin 14) of RAM transition generator 170. Accordingly, it can be seen that analog gate 260 similarly modulates the amplitude of the fricative excitation signal in accordance with the duty cycle of the fricative amplitude (FA) control signal. The control terminal of analog gate 258 is connected to the output of a comparator amplifier 256 which has its negative input connected to a reference potential and its positive input connected to receive the amplitude controlled vocal source signal present at node 254. Thus, whenever the amplitude of the voiced excitation signal exceeds the predetermined threshold potential supplied to the negative input of comparator 256, an output signal is provided to the control terminal of analog gate 258 causing analog gate 258 to "chop" the fricative excitation signal. The purpose of this chopper circuit is to amplitude modulate the fricative excitation energy that is injected into the vocal tract during voiced fricative phonemes when vocal energy is also being injected.

The chopped and amplitude controlled fricative excitation signal is then passed through a second order low-pass filter 262 and a high-pass filter 264 and combined with the vocal excitation signal at node 266. The combined voiced and unvoiced excitation signals are then passed through a final high-pass filter 268 before being injected into the vocal tract 28 shown in FIG. 7.

Looking to FIG. 7, the novel analog delay line vocal tract 28 of the present invention will now be described. As noted previously, the analog delay line in the preferred embodiment includes five sections each comprising a resistive series component and a frequency dependent negative resistance (FDNR) shunt component. In particular, the first section of the delay line comprises resistor R10 and FDNR $\overline{R}$10, the second section comprises resistor R12 and FDNR $\overline{R}$12, the third section comprises resistor R14 and FDNR $\overline{R}$14, the fourth section comprises resistor R16 and FDNR $\overline{R}$16, and the fifth section comprises resistor R18 and FDNR $\overline{R}$18. A damping resistor R20–R28 is also inserted in each FDNR, $\overline{R}$10–$\overline{R}$18 respectively, to add a loss term to each section of the delay line to simulate the loss of energy that occurs along the length of the human vocal tract. The four reflection coefficient control signal parameters RC1–RC4 are utilized to electronically vary the values of the series resistances R10–R16 in the first four sections of the vocal tract 28. Specifically, reflection coefficient RC1 is connected to the control terminals of analog gates 232 and 234 which are connected in series with resistor R10. Reflection coefficient RC2 is provided to the control terminal of analog gate 236 which is connected in series with resistor R12. Reflection coefficient RC3 is supplied to the control terminals of analog gates 238 and 240 which are connected in series with resistor R14. And reflection coefficient RC4 is connected to the control terminal of analog gate 242 which is connected in series with resistor R16. Two parallel connected analog gates 232, 234 and 238, 240 are used in the first and third sections to reduce the effective resistance of the analog gates in relation to the series resistors, R10 and R14 respectively.

Since the duty cycle frequencies of the reflection coefficient control signal parameters RC1–RC4 are several times faster than the audible range of frequencies generated by the vocal tract 28, it will be appreciated that the effective resistances of the series resistors R10–R16 in the first four sections of the vocal tract 28 will vary in accordance with the duty cycles of the reflection coefficient control signal parameters, RC1–RC4 respectively. By varying the series resistances in the first four sections of the vocal tract 28, the impedance of the delay line is varied at different points along its length, thus simulating the variations in the cross-sectional area that occur in the human vocal tract.

The embodiment of the vocal tract 28 described herein is utilized in the present system because of the exceptional quality of speech produced thereby given the relative simplicity of the circuit and the minimum number of control signal parameters required. However, as will be appreciated by those skilled in the art, the concept of the present analog delay line vocal tract is subject to numerous modifications and variations without departing from the scope of the present invention. For example, since each section of the delay line represents a given length of the human vocal tract, it can be seen that by adding additional sections to the delay line, the length represented by each section is reduced, thereby increasing the precision of the model. Accordingly, the present vocal tract 28 could be expanded to include eight or even ten sections with additional control signal parameters controlling each section to further improve the quality of the speech produced. Moreover, it is known that in the human vocal tract, despite changes in its cross-sectional area, the length of the vocal tract remains approximately constant. Therefore, to optimize the model, it is further desirable to vary the effective values of the FDNRs inversely with respect to changes in their associated series resistances. In this manner, the (C/L) quantity, which is proportional to cross-sectional area, is varied while the (LC) product, which is proportional to length, is kept constant. With the present analog delay line, this can readily be accomplished by controlling an analog gate inserted in series with the resistor (designated 280 in the first section) of each FDNR. Thus, it can be seen that both the series and shunt components in the analog delay line of the present invention are readily tunable.

Finally, returning to FIG. 8, the output from the vocal tract 28 is provided to the output filter control network 38 which spectrally shapes the audio output waveform. In particular, the output from the vocal tract 28 is initially provided to an analog gate that is controlled by the closure control signal parameter (CL). As noted previously, the closure control signal (CL) is utilized to cause an abrupt amplitude modulation in the audio output to simulate the buildup and sudden release of energy that occurs during the pronunciation of such phonemes as "b" and "p". The audio output signal is then provided through a first low-pass filter 272 to a second parameter controlled low-pass filter 276 that is adapted to produce a gradual roll-off in the audio output spectrum above a certain frequency as determined by the spectral contour control signal (SC) provided to the control terminal of analog gate 274.

While the above description constitutes the preferred embodiment of the invention, it will be appreciated that the invention is susceptible to modification, variation and change without departing from the proper scope or fair meaning of the accompanying claims.

What is claimed is:

1. A phoneme based speech synthesizer comprising parameter storage means for generating a plurality of steady-state control signals for each phoneme and a vocal tract model that is tunable in accordance with said plurality of control signals; the improvement comprising digital transition means connected between said parameter storage means and said vocal tract model for gradually transitioning the abrupt changes in the steady-state values of said control signals generated by said parameter storage means from phoneme to phoneme, including:

timing means including first counter means for dividing each control signal into a plurality of time-weighted bit intervals including a MSB interval and a LSB inteval, and second counter means for dividing each bit interval into a plurality of time slots;

transition rate means including third counter means adapted to count to the number of time slots in a bit interval at a rate which determines the transition rate of said control signals;

comparator means for comparing the outputs of said second and third counter means and producing an output signal whenever the outputs of said second and third counter means are equal; and digital storage means for storing a data bit for each time slot in each of said plurality of control signals, including a plurality of data inputs each connected to receive one of said control signals generated by said parameter storage means, a corresponding plurality of data outputs for producing said time-weighted duty cycle control signals, a first control input responsive to said comparator means for loading into said digital storage means the data present at said data inputs whenever said comparator output signal is produced, and a second control input responsive to said timing means for determining the time slots into which said data will be loaded.

2. The speech synthesizer of claim 1 further including phoneme timer means responsive to a phoneme timing control signal produced for each phoneme and comprising a fourth counter means for counting a predetermined number of counts at a rate controlled by said phoneme timing control signal over a period of time which establishes the duration of each phoneme.

3. The speech synthesizer of claim 2 further including speech rate control means for producing a speech rate signal for varying the count rate of both said third and fourth counter means.

4. The speech synthesizer of claim 3 wherein said speech synthesizer is responsive to a digital input command word and said speech rate control means is responsive to certain of the bits in said digital input command word.

5. The speech synthesizer of claim 3 wherein the count rate of said third counter means is also controlled by a transition rate control signal produced for each phoneme.

6. The speech synthesizer of claim 1 wherein the count rate of said second counter means is substantially faster than the count rate of said third counter means such that for each count of said third counter means said comparator means will produce an output signal at least once for each of said plurality of bit intervals.

7. The speech synthesizer of claim 6 wherein said digital storage means comprises a random-access memory (RAM), said first control input comprises the READ/WRITE input of said RAM, and said second control input comprises the address inputs of said RAM.

8. The speech synthesizer of claim 7 wherein the outputs of said first and second counter means which uniquely identify each time slot in each bit interval are provided to the address inputs of said RAM.

9. The speech synthesizer of claim 8 wherein said address inputs of said RAM also determine the address of the data to be read from said RAM.

10. The speech synthesizer of claim 9 wherein said RAM provides at said data outputs the data contained in the address locations identified by said address inputs whenever said comparator output signal is not produced.

11. The speech synthesizer of claim 3 wherein said synthesizer further includes a vocal source for producing a vocal excitation signal and a noise source for producing a fricative excitation signal and a second plurality of control signals generated for each phoneme for controlling the injection of said vocal and fricative excitation signals into said vocal tract; and said digital transition means further includes:

second transition rate means including a fifth counter means adapted to count the number of time slots in a bit interval at a rate which determines the transition rate of said second plurality of control signals, second comparator means for comparing the outputs of said second and fifth counter means and producing an output signal whenever the outputs of said second and fifth counter means are equal, and second digital storage means for storing a data bit for each time slot in each of said second plurality of control signals, including a plurality of data inputs each connected to receive one of said second plurality of control signals generated by said parameter storage means, a corresponding plurality of said outputs for producing a second plurality of said time-weighted duty cycle control signals, a first control input responsive to said second comparator means for loading into said second digital storage means the data present at said data inputs whenever said second comparator output signal is produced, and a second control input responsive to said timing means for determining the time slots into which said data will be loaded.

12. The speech synthesizer of claim 11 wherein the speech rate signal produced by said speech rate control means varies the count rate of said fifth counter means.

13. The speech synthesizer of claim 12 further including inflection control means for producing an inflection control signal that is adapted to vary the fundamental frequency of said vocal excitation signal; and said digital transition means further includes inflection transition generator means for digitally generating gradual changes in the value of said inflection control signal as it changes from phoneme to phoneme.

14. The speech synthesizer of claim 13 wherein the transition rate of said inflection transition generator means is also determined by the count rate of said fifth counter means.

15. The speech synthesizer of claim 14 wherein said inflection transition generator means comprises shift register means having a serial data input for receiving said inflection control signal, a plurality of parallel data outputs each connected to a binary-weighted resistor and then tied in common for producing the transitioned inflection control signal, and a clock input connected to the output of said fifth counter means.

16. A phoneme based speech synthesizer comprising parameter storage means for generating a plurality of steady-state control signals for each phoneme and a vocal tract model that is tunable in accordance with said plurality of control signals; the improvement comprising digital transition means connected between said parameter storage means and said vocal tract model for gradually transitioning the abrupt changes in the steady-state values of said control signals generated by said parameter storage means from phoneme to phoneme, comprising:

digital storage means for storing in a plurality of storage locations a first steady-state value for each of said control signals;

storage input means for gradually updating the contents of said digital storage means by inputting at a predetermined rate a second steady-state value for each of said control signals into one of said plurality of storage locations; and storage output means for outputting the contents of said digital storage means so that the value of each of said control signals is substantially equal to the average of the steady-state values currently stored in said plurality of storage locations.

17. The speech synthesizer of claim 16 wherein said digital transition means further includes transition rate means for controlling the rate at which the contents of said digital storage means is updated with new data by said storage input means, including a first counter means that is adapted to count a predetermined number of counts over a period of time which determines the transition period for said digital transition means.

18. The speech synthesizer of claim 17 further including phoneme timing means for controlling the period of each phoneme, including second counter means adapted to count a pre-established number of counts over a period of time that determines the phoneme time period.

19. The speech synthesizer of claim 18 further including speech rate means for controlling the speech rate of the audio output by producing a signal that is adapted to vary the count rate of both said first and second counter means.

20. The speech synthesizer of claim 16 wherein said control signals comprise time-weighted duty cycle control signals having a MSB interval and a LSB interval and said storage output means outputs the contents of said digital storage means in a time-weighted manner such that the data in said MSB interval is produced for a period twice as long as the period of production for the data in the next MSB interval and the data in said LSB interval is produced for a period twice as short as the period of production for the data in the next LSB intervals.

21. The speech synthesizer of claim 20 wherein said vocal tract includes an electronic representation of an LC delay line comprises of a plurality of sections, each of said sections comprising a series resistance component and a frequency dependent negative resistance (FDNR) shunt component, and tuning means responsive to said control signals for tuning at least some of said sections.

22. The speech synthesizer of claim 21 wherein said tuning means is adapted to tune said delay line in accordance with the duty cycles of said control signals.

23. The speech synthesizer of claim 22 wherein said tuning means is adapted to vary the series resistance component in some of said sections.

24. The speech synthesizer of claim 23 wherein said tuning means comprises electronic switch means connected to said series resistance components and controlled by said control signals.

25. The speech synthesizer of claim 24 wherein said delay line is comprised of five sections.

26. The speech synthesizer of claim 25 wherein said tuning means is adapted to tune the first four sections of said delay line.

27. The speech synthesizer of claim 26 wherein said tuning means is responsive to four control signals.

28. The speech synthesizer of claim 20 wherein said speech synthesize further includes means for generating a vocal excitation signal, means for generating a fricative excitation signal, and means for combining said excitation signals and injecting the combined signal into the first section of said delay line.

29. The method of digitally generating a gradual transition in the value of a control signal in a phoneme based speech synthesizer including a vocal tract that is tunable in accordance with a plurality of control signals generated for each phoneme, including the steps of:

defining a time frame over which the value of said control signal is determined;

dividing said time frame into a plurality of bit intervals including a MSB interval and a LSB interval;

dividing each of said bit intervals into a plurality of data bits; and updating substantially simultaneously one data bit in each of said bit intervals so that the average value of said control signal over said time frame is gradually updated.

30. The method of claim 29 further including the step of generating a transition rate count to control the rate at which the data bits in each bit interval are updated.

31. The method of claim 30 wherein one data bit in each of said bit intervals is updated for each count of said transition rate count.

32. The method of claim 29 wherein said control signals comprise time-weighted duty cycle control signals and said time frame is divided into a plurality of time-weighted bit intervals such that said MSB bit interval is twice as long as the next MSB bit interval and said LSB bit interval is twice as short as the next LSB bit interval.

33. The method of claim 32 wherein there are four time-weighted bit intervals in a time frame.

34. the method of claim 32 wherein there are sixteen data bits in each bit interval except for said LSB interval which contains eight data bits.

35. The method of claim 34 wherein one of the data bits in said LSB interval is updated for every two data bits in the three most significant bit intervals.

36. The method of claim 31 further including the step of generating a speech rate signal for controlling the speech rate of the audio output, and varying the count rate of said transition rate count in accordance with said speech rate signal.

37. The method of claim 36 wherein the count rate of said transition rate count is also controlled by a transition rate control signal generated for each phoneme.

38. In a phoneme-based synthesizer including a vocal tract model that is controlled in accordance with a plurality of control signals generated for each phoneme; the improvement comprising digital transition means for gradually changing the parameter value of a control signal from an old parameter value toward a new parameter value including:

digital storage means for storing in a plurality of storage locations one or more past parameter value(s) of said control signal;

input means for gradually updating the contents of said digital storage means by inputting at a predetermined rate said new parameter value into each of said plurality of storage locations; and output means for producing an output control signal having a parameter value substantially equal to the average of the parameter values stored in said plurality of storage locations.

39. The speech synthesizer of claim 38 wherein said input means inputs said new parameter value first into the storage location containing the oldest past parameter value.

40. The speech synthesizer of claim 39 wherein said input means updates the contents of one of said plurality of storage locations at a time.

41. The speech synthesizer of claim 40 wherein one of said plurality of control signals is a transition rate control signal and the parameter value of said transition rate control signal determines said predetermined rate.

42. The method of digitally generating a gradual transition in the parameter value of a control signal in a phoneme-based synthesizer including a vocal tract model that is controlled in accordance with a plurality of control signals generated for each phoneme, including the steps of:

storing in a plurality of digital storage locations one or more past parameter value(s) of said control signal, sequentially updating the contents of said plurality of digital storage locations at a predetermined rate with a new parameter value for said control signal, and assigning to said control signal a parameter value substantially equal to the average of the parameter values stored in said plurality of digital storage locations.

43. The method of claim 42 wherein the storage location containing the oldest past parameter value for said control signal is updated first.

44. The method of claim 43 wherein the contents of said plurality of storage locations are updated with said new parameter value one at a time.

* * * * *